US011111591B2

(12) United States Patent
Nulwala et al.

(10) Patent No.: US 11,111,591 B2
(45) Date of Patent: Sep. 7, 2021

(54) METHODS AND COMPOSITIONS FOR ELECTROCHEMICAL DEPOSITION OF METAL RICH LAYERS IN AQUEOUS SOLUTIONS

(71) Applicant: LumiShield Technologies Incorporated, Pittsburgh, PA (US)

(72) Inventors: Hunaid B. Nulwala, Pittsburgh, PA (US); John D. Watkins, Pittsburgh, PA (US)

(73) Assignee: LUMISHIELD TECHNOLOGIES INCORPORATED, Pittsburgh, PA (US)

( * ) Notice: Subject to any disclaimer, the term of this patent is extended or adjusted under 35 U.S.C. 154(b) by 253 days.

(21) Appl. No.: 15/995,220

(22) Filed: Jun. 1, 2018

(65) Prior Publication Data

US 2018/0347058 A1 Dec. 6, 2018

Related U.S. Application Data

(60) Provisional application No. 62/513,654, filed on Jun. 1, 2017.

(51) Int. Cl.
*C25D 3/02* (2006.01)
*C25D 3/54* (2006.01)
(Continued)

(52) U.S. Cl.
CPC ..... *C25D 3/44* (2013.01); *C25D 3/54* (2013.01); *C25D 3/56* (2013.01); *C25D 5/10* (2013.01);
(Continued)

(58) Field of Classification Search
CPC ..... C25D 3/02; C25D 3/54; C25D 3/56
(Continued)

(56) References Cited

U.S. PATENT DOCUMENTS

2006/0272950 A1* 12/2006 Martyak ..... C07C 303/44 205/261
2007/0108061 A1* 5/2007 Lisowsky ..... C25D 3/42 205/238
(Continued)

FOREIGN PATENT DOCUMENTS

EP 0175901 A1 4/1986
JP 2005264230 A * 9/2005 ..... C23C 22/83
(Continued)

OTHER PUBLICATIONS

Reid et al., "Electrodeposition of metals from Organic Solutions III. Preparation and Electrolytes of Titanium and Zirconium Compounds in Nonaqueous Media," Journal of the Electrochemical Society (Jan. 1957), vol. 104, No. 1, pp. 21-29.*
(Continued)

*Primary Examiner* — Edna Wong
(74) *Attorney, Agent, or Firm* — Potomac Law Group, PLLC; Jeremy A. Cubert

(57) ABSTRACT

Methods and compositions for electrodepositing mixed metal reactive metal layers by combining reactive metal complexes with electron withdrawing agents are provided. Modifying the ratio of one reactive metal complex to the other and varying the current density can be used to vary the morphology the metal layer on the substrate.

17 Claims, 18 Drawing Sheets

(51) Int. Cl.

| | |
|---|---|
| ***C25D 3/56*** | (2006.01) |
| ***C25D 3/44*** | (2006.01) |
| ***C25D 9/08*** | (2006.01) |
| ***C25D 9/12*** | (2006.01) |
| ***C25D 9/10*** | (2006.01) |
| ***C25D 5/10*** | (2006.01) |

(52) U.S. Cl.
CPC ..... *C25D 9/08* (2013.01); *C25D 9/10* (2013.01); *C25D 9/12* (2013.01)

(58) Field of Classification Search
USPC ..... 205/238, 261, 262
See application file for complete search history.

(56) References Cited

U.S. PATENT DOCUMENTS

| | | | | |
|---|---|---|---|---|
| 2008/0230394 | A1* | 9/2008 | Inbe | C25D 13/20 205/241 |
| 2009/0297802 | A1* | 12/2009 | Sastry | C23C 18/165 428/209 |
| 2011/0076505 | A1* | 3/2011 | Ishii | C23C 22/82 428/472 |
| 2012/0018053 | A1* | 1/2012 | Nagaya | C23C 22/53 148/247 |
| 2013/0309404 | A1* | 11/2013 | Kilian | C23C 18/31 427/307 |
| 2017/0306517 | A1 | 10/2017 | Cojocaru et al. | |
| 2020/0017358 | A1* | 1/2020 | Matsumoto | H01L 29/0665 |

FOREIGN PATENT DOCUMENTS

| | | | |
|---|---|---|---|
| JP | 2005264230 | A | 9/2005 |
| WO | 2017142513 | A1 | 8/2017 |

OTHER PUBLICATIONS

Viestfrid et al., "Microelectrode Studies of Reversible Mg Deposition in THF Solutions Containing Complexes of Alkylaluminum Chlorides and Dialkylmagnesium," Journal of Electroanalytical Chemistry (2005), vol. 576, pp. 183-195.*

International Search Report and Written Opinion dated Oct. 17, 2018 for International Patent Application No. PCT/US2018/035577.

Chaim et al., "Electrolytic ZrO2 Coatings, II. Microstructural Aspects," J. Electrochem. Soc., Jul. 1991, vol. 138(7), pp. 1942-1946.

Invitation to Pay Additional Fees with Partial International Search issued in International Patent Application No. PCT/US2018/035577 dated Aug. 20, 2018.

Katayama et al., "Electrochemical Study on Aluminum Speciation in Lewis Acidic Chloroaluminate-Bis (trifluoromethylsulfonyl)amide Mixed Ionic Liquids," Electrochemistry, Jan. 31, 2018, vol. 86(2), pp. 42-45.

Yang et al., "Electrochemical preparation of Ni—La alloys from the EMIC-EG eutectic-based ionic liquid," Ionics, Jul. 2017, vol. 23(7), pp. 1703-1710.

European Communication Pursuant to Rules 161(1) and 162 EPC dated Jan. 13, 2020, issued in European Application No. 18733453.7.

Pulletikurthi et al., "Electrodeposition of Refractory Metals fromIonic Liquids," Electrodeposition from Ionic Liquids, 2008, pp. 104-119, Wiley-VCH Verlag GmbH & Co., KGaA, Weinheim, Germany.

Xu, et al., "Electrochemical Preparation of Titanium and its Alloy in Ionic Liquid," Ionic Liquids—Current State of the Art, 2015, pp. 481-503, The Authors.

Office Action (First Examination Report) dated Jul. 23, 2020 for Indian Patent Application No. 201917049086.

Hagfeldt et al., "Structure of the hydrated, hydrolysed and solvated zirconium(IV) and hafnium(IV) ions in water and aprotic oxygen donor solvents. A crystallographic, EXAFS spectroscopic and large angle X-ray scattering study," Dalton Trans., 2004, pp. 2142-2141, The Royal Society of Chemistry, London, United Kingdom.

Hearing Notice dated Mar. 16, 2021 for Indian Patent Application No. 201917049086.

Office Action (First Examination Report) dated Mar. 8, 2021 for Canadian Patent Application No. 3065510.

Vacca et al., "Electrodeposition of Zirconium from 1-butyl-1-methylpyrrolidinium-bis(trifluoromethylsulfonyl)imide: Electrochemical Behavior and Reduction Pathway," Materials and Manufacturing Processes, 2015, pp. 1-23, Taylor & Francis, London, United Kingdom.

Vanysek, "Electrochemical Series," ASM Handbook—Corrosion Series, 2010, vol. 13B, pp. 8-20-8-29.

* cited by examiner

METHODS AND COMPOSITIONS FOR ELECTROCHEMICAL DEPOSITION OF METAL RICH LAYERS IN AQUEOUS SOLUTIONS

CROSS-REFERENCE TO RELATED APPLICATIONS

This application claims the benefit of U.S. Provisional Application No. 62/513,654, filed Jun. 1, 2017, which is incorporated herein by reference in its entirety.

STATEMENT REGARDING FEDERALLY SPONSORED RESEARCH

This invention was made with government support under 1548805 and 1660132 awarded by the National Science Foundation (NSF). The government has certain rights in the invention.

All references cited herein, including but not limited to patents and patent applications, are incorporated by reference in their entirety.

BACKGROUND

In its metallic form, zirconium (Zr) is an important metal component in the nuclear industry. It is most often used in an alloy form as a cladding material due to its extreme corrosion resistance and small neutron capture cross section. Additionally, both Zr metal and Zirconium oxide ($ZrO_2$) show extreme tolerance to high temperature applications in both pure and alloyed forms. Therefore, Zr is used extensively in high performance parts exposed to high temperatures, most notably as a coating material for the space shuttle. Zr and aluminum (Al) impart corrosion-resistant properties to metal surfaces and have many applications (e.g., decorative coatings, performance coatings, surface aluminum alloys, electro-refining processes, and aluminum-ion batteries). However, due to the large reduction potential of some metals, these materials have been exclusively used in non-aqueous media. Non-aqueous media (e.g., inorganic molten salts, ionic liquids, and molecular organic solvents) require a relatively high temperature (e.g., >140° C.) and may be prone to the volatilization of corrosive gases. In addition, electrodeposition methods in non-aqueous media are costly and environmentally hazardous.

Zirconium, like aluminum, titanium etc., is a reactive metal and is not typically able to be electrodeposited from aqueous solutions. Zirconium has standard reduction potential of −1.45V vs. SHE (standard hydrogen electrode), but the real value in water would be much more negative due to the spontaneous formation of its water hydroxide salt. Thus, reactive metals (Zr, Al, Ti, Nb, Mn, V) are not typically able to be electrodeposited from aqueous solutions. See, e.g., Katayama et al., Electrochemistry, 86(2), 42-45 (2018); Yang et al., Ionics (2017) 23:1703-1710. Methods for electrodepositing certain reactive metals from aqueous solutions are described in PCT/US2016/018050, hereby incorporated by reference in its entirety. See, also, EP0175901, page 10.

Currently, zirconium metal and its oxides are applied to surfaces using a hot roll bonding process, which relies on welding sheet surfaces together at elevated temperatures. However, this process is only able to adhere relatively thick layers, is highly labor intensive, and defects inherent in the process can result in undesirable delamination. While an electrodeposition alternative has been developed, it relies on the use of molten salt eutectics and suffers from the drawbacks of other reactive metal plating techniques in non-aqueous media (e.g., high temperatures, removal of oxygen and water, environmental hazards). Thus, these methods are difficult and expensive to reproduce and to scale.

Zirconia ceramics are known to provide excellent corrosion resistance, heat stability, and biocompatibility to metal parts with only a very thin layer. The cathodic electrodeposition of such materials has been attempted, but in general poor adhesion and substantial cracking of these materials is observed. See, e.g., R. Chaim, I. Siberman and L. Gal-Or, "Electrolytic ZrO2 Coatings" J. Electrochem. Soc., Vol. 138, No. 7, July 1991. What is needed are compositions for and methods of electrodepositing one or more layers of substantially metallic film on metallic surfaces (steel, copper, gold etc.) having a desired morphology (e.g., dense, continuous, and adherent) while optionally allowing for natural oxidation of the deposited layer.

SUMMARY

Aspects described herein provide methods of electrodepositing metal-rich layers comprising one or more reactive metals using a mixture of zirconium and aluminum in a substantially aqueous medium. In one aspect, electrodeposition carried out using compositions comprising zirconium and aluminum salts in an aqueous medium deposits an initial layer of metal rich zirconium prior to the deposition of aluminum, at low overpotential. In another aspect, an initial layer of zirconium is electrodeposited prior to further layers of zirconium and/or zirconium oxide. Without being bound by theory, it is believed that use of compositions comprising zirconium and aluminum facilitates electrodeposition of reactive metals in an a substantially aqueous medium.

In one aspect, compositions comprising a first metal complex having a first reactive metal and an electron withdrawing ligand, and a second metal complex comprising a second reactive metal and an electron withdrawing ligand are provided.

In another aspect, methods of electrodepositing at least one reactive metal onto a surface of a conductive substrate are provided. In this aspect, methods comprise electrochemically reducing a first metal complex comprising zirconium and a second metal complex comprising aluminum, wherein the first metal complex and the second metal complex are dissolved in a substantially aqueous medium wherein at least a first layer of zirconium is deposited onto the surface of the conductive substrate.

In a further aspect, kits for electrodepositing at least one reactive metal onto a surface of a conductive substrate comprising a solution of zirconium metal complex and a solution of aluminum metal complex are provided.

In one aspect, the relative proportions of aluminum and the secondary metal (e.g., zirconium can be controlled by concentration, electrolyte identity, and applied current density. In another aspect, the synergistic effects from using aluminum in a mixed metal solution modifies hydrogen reduction in a manner such that plating is not disrupted by heavy gassing allowed the deposition or more compact and less porous films.

In a further aspect, quartz crystal microbalance (QCM) can be used to measure the rate of metal deposition. Metal layers deposited by aspects described herein can be interrogated and characterized by, for example, a combination of scanning electron microscopy (SEM), energy dispersive X-ray spectroscopy (EDX) and X-ray photoelectron spectroscopy (XPS). Metal complexes between reactive metals and electron withdrawing ligands (e.g., organic sulfonate ligands), have been used to produce stable reactive metal salts in water, and already shown to allow the deposition of metal rich oxides of aluminum from water. However, methods and compositions described herein permit depositing single or multiple reactive metal layers having customized morphology based on the relative amounts of more than one metal complexed with electron withdrawing ligands to lower the reduction potential of each metal.

DETAILED DESCRIPTION

Figure 1:
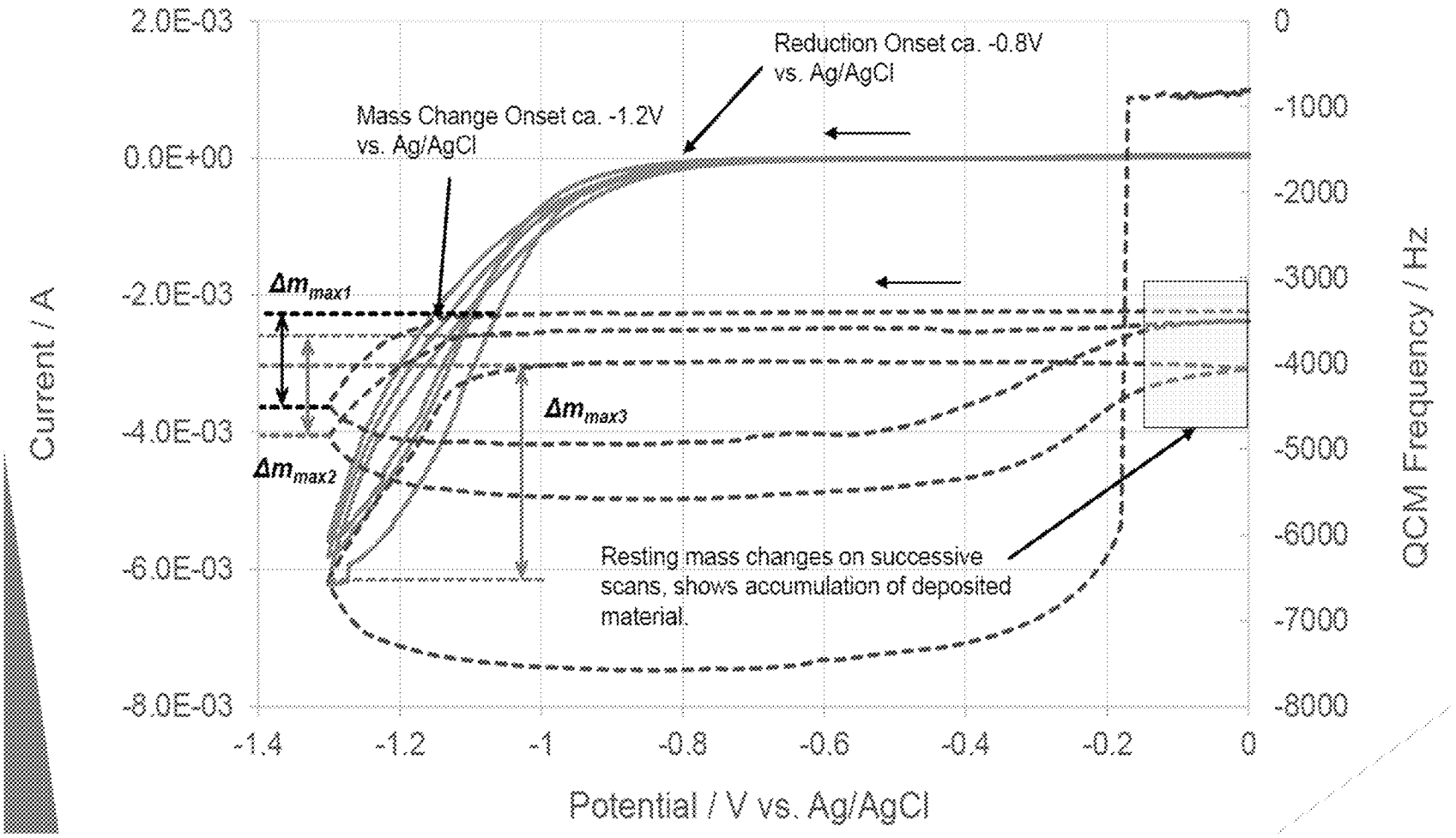
FIG. 1 provides the results of an exemplary dynamic EQCM (electrochemical quartz crystal microbalance) trace showing cyclic voltammograms over 3 cycles (solid line) with concurrent mass change resulting from the indicated deposited metal (vs Ag/AgCl) via EQCM frequency (broken line) in 3 mL of 0.2M Zr(LS), 0.2M Al(LS) and 0.28M $NaClO_4$ at pH 2.44.

Aspects described herein provide compositions and methods for electrodeposition of metallic rich layers of reactive metal from aqueous solutions. While electron withdrawing ligands have been previously used by the present inventors to stabilize aluminum complexes in water and lower the reduction potential to allow ease of electrodeposition, aspects described herein further describe co-electrodeposition of other reactive metals in the presence of these aluminum complexes. For example, zirconium and other reactive and non-reactive metals (e.g., (magnesium, manganese, titanium, vanadium, niobium, tungsten, chromium (III), zinc, copper) can be used in a synergistic combination with a secondary metal to further decrease the reduction potential of that secondary metal.

Aspects described herein provide a solution comprising a ligated aluminum complex in water with a coordinated electron withdrawing ligand. In addition, the secondary metal of interest for co-deposition is mixed with the ligated aluminum complex solution and coordinated with the same or different electron withdrawing ligand. In another aspect, an electrolyte, (e.g., sodium perchlorate) can included to facilitate conductivity. The ratio of aluminum to the secondary metal can be varied to change the metallic content and relative metal content of the deposited layer. In one aspect, a 1:1 ratio can be used. Optionally, a buffer can also be included. As described herein, the temperature and pH can also be adjusted.

In one aspect, the electron withdrawing ligands can be in the form of an organic sulfonate (e.g., methane sulfonate). In another aspect, the metal sulfonate complexes can be formed by the reaction of the electron withdrawing ligand (e.g., methanesulfonic acid) with a basic metal salt in water, generating a stable and soluble metal complex as a concentrate. These synthetic metal complex concentrates can then be mixed to form the overall plating solution with the electrolyte and any desired additives (e.g. buffers). The pH can adjusted as needed by the addition of a buffer (e.g., sodium bicarbonate or methanesulfonic acid) to reach a stable pH of, for example, between 2 and 3.

Thus, aspects described herein provide compositions and methods for electrodeposition of zirconium metal rich layers on conductive surfaces using water stable aluminum salts as hydroxide mediators and electron withdrawing ligands to lower the reduction potential of the reactive metals, allowing the reduction to effectively compete with water splitting.

Further aspects describe mixing the aluminum metal complexes with an equivalent electron poor zirconium source to co-deposit metal oxide layer on a conductive surface. In one aspect, the nature of this surface may be controlled by the application of varying current density. For example, at low values of current density, electrodeposition of metallic zirconium is favored, with a small amount of aluminum present. In another example, at higher current density, the relative amount of aluminum to zirconium in the layer is closer to 1:1. However, the layer becomes more oxidized in nature.

As described herein, the present inventors used EQCM to measure the mass change of a gold electrode concurrently with electrodeposition. In this way, the surface was interrogated to measure concurrent deposition events associated with reduction. In this aspect, a mass change indicates that a closely binding layer is associated with the electrode as non-adherent layers and non-deposition events do not register a mass change with the EQCM.

In another aspect, the effect of gassing may be inferred from the results since heavy gassing events give a highly irregular mass change masking electrodeposition. In this aspect, the EQCM will register a mass gain if an adherent layer is formed with little to no gas generation.

Aspects described herein show a positive synergistic effect on reducing the hydrogen gas evolution using the mixed metal compositions and methods described herein. In the presence of either the aluminum complex or the zirconium complex alone, significant gas evolution was detected by EQCM which, it is believed, quickly destabilized the crystal. However, in this aspect, if both metals are included, a prolonged resistance of the EQCM to gassing is shown by the stability of the signal over multiple 1 mV/s cyclic voltammetry scans. In this example, it is believed that the bubbles are either removed from the surface rapidly, before they can interfere with the gold surface significantly, or the hydrogen evolution process is disfavored. In either case the metal deposition process can proceed with far less surface competition with gas evolution leading to more compact films with less porosity.

The term "reactive metal" refers to metals that are reactive to, among other things, oxygen and water (e.g., aluminum, titanium, manganese, gallium, vanadium, zirconium, and niobium). Reactive metals include self-passivating metals containing elements which can react with oxygen to form surface oxides (e.g., oxides of Cr, Al, Ti, Mn, V, Ga, Nb, Mg and Zr). These surface oxide layers are relatively inert and prevent further corrosion of the underlying metal. Methods described herein permit "tuning" of the desired degree of production of surface oxides.

Examples of non-reactive metals include tin, gold, copper, silver, rhodium, and platinum. Additional metals that can be electrodeposited using the electrodeposition methods described herein include molybdenum, tungsten, iridium, gallium, indium, strontium, scandium, yttrium, magnesium, manganese, chromium, lead, tin, nickel, cobalt, iron, zinc, niobium, vanadium, titanium, beryllium, and calcium.

The term "metal complex" refers to a chemical association between a metal and an electron withdrawing ligand, as described in PCT/US2016/018050, including metal complexes with the general formula:

$$(M_1L_aL_b)_p(M_2L_aL_b)_d$$

wherein $M_1$ and $M_2$ each, independently represents a metal center; L is an electron withdrawing ligand; p is from 0 and 5; and d is from 0 and 5; a is from 1 to 8 (e.g., from 1 to 4; from 0.5 to 1.5; from 2 to 8; 2 to 6; and 4 to 6); and b is from 1 to 8 (e.g., from 1 to 4; from 0.5 to 1.5; from 2 to 8; 2 to 6; and 4 to 6). The metal complexes contemplated herein, therefore, can include metal complexes comprising more than one metal species and can even include up to ten different metal species when p and d are each 5. In addition, each of the metal complexes can have the same or different ligands around the metal center.

The term "electron withdrawing ligand" refers to a ligand or combination of one or more (e.g., two to three; two to six; three to six; or four to six ligands) associated with the metal center, wherein the ligand or ligands are sufficiently electron withdrawing such that the reduction potential of the metal center in the metal complex is decreased below the over-potential for the evolution of hydrogen gas due to water splitting. The term "over-potential for the evolution of hydrogen gas due to water splitting" refers, in some instances, to a potential more negative than −1.4 V versus Ag/AgCl, where one generally observes significant hydrogen generation.

In some embodiments, electron withdrawing ligands can be ligands wherein the conjugate acid of the ligand has a pKa of from about 2 to about −5 (e.g., about −1.5 to about −4; about −2 to about −3; about −2 to about −4; about −1 to about −3; and about 2 to about −2).

Metal complexes and electron withdrawing ligands can be made as described in PCT/US2016/018050, hereby incorporated by reference in its entirety.

The term "substantially aqueous medium" refers to a medium (e.g., used in an electrodeposition bath) comprising at least about 50% water (e.g., 40%, 50%, 60%, 70%, 80%, 90%, 99%, 100% water) and as described in PCT/US2016/018050, hereby incorporated by reference in its entirety. The substantially aqueous medium can comprise, in certain aspects, an electrolyte, water-miscible organic solvent, buffer etc. as described in PCT/US2016/018050.

The term "electrolyte" refers to, for example, any cationic species coupled with a corresponding anionic counterion (e.g., some of the sulfonate ligands, sulfonimide ligands, carboxylate ligands; and β-diketonate ligands described herein) and as described in PCT/US2016/018050, hereby incorporated by reference in its entirety.

Examples of electrolytes include electrolytes comprising at least one of a halide electrolyte (e.g., tetrabutylammonium chloride, bromide, and iodide); a perchlorate electrolyte (e.g., lithium perchlorate, sodium perchlorate, and ammonium perchlorate); an amidosulfonate electrolyte; hexafluorosilicate electrolyte (e.g., hexafluorosilicic acid); a tetrafluoroborate electrolyte (e.g., tetrabutylammonium tetrafluoroborate); a sulfonate electrolyte (e.g., tin methanesulfonate); and a carboxylate electrolyte.

Examples of carboxylate electrolytes include electrolytes comprising at least one of compound of the formula $R^3CO_2^-$, wherein $R^3$ is substituted or unsubstituted $C_6$-$C_{18}$-aryl; substituted or unsubstituted $C_1$-$C_6$-alkyl. Carboxylate electrolytes also include polycarboxylates such as citrate (e.g., sodium citrate); and lactones, such as ascorbate (e.g., sodium ascorbate.

In certain aspects, the metal complex serves a dual function as the metal complex and electrolyte. The metal complex and optional buffer, metal complex and non-buffering electrolyte, and metal complex and non-buffering salt can also serve as an electrolyte.

Aspects described herein provide compositions comprising a first metal complex comprising a first reactive metal and a first electron withdrawing ligand and second metal complex comprising a second reactive metal and a second electron withdrawing ligand. In this aspect, the first reactive metal is more electronegative than the second reactive metal.

In one aspect, the first reactive metal is selected from the group consisting of zirconium, aluminum, titanium, manganese, gallium, vanadium, zirconium, and niobium. In another aspect the second reactive metal is selected from the group consisting of aluminum, zirconium, titanium, manganese, gallium, vanadium, zirconium, and niobium. In another aspect, the first reactive metal is more electronegative than the second reactive metal. The relative electronegativity of a reactive metal can be determined, for example, from an Electromotive Series table (see, e.g., EP0175901, page 10).

Without being bound by theory, it is believed the electrodeposition of the initial reduction layer with a metal lower on the electromotive series (more negative) assists electroreduction and electroprecipitation of metals higher in the series (e.g., Al helps Zr deposition, Mg aids Al electrodeposition. Examples of metal pairs corresponding to a first reactive metal and a second reactive metal, respectively, include Mg—Al, Al—Zr, Al—Ti, Al—Mn, Al—V, Al—Nb, Mg-M, and Ca—Mg.

In another aspect, the first electron withdrawing ligand and the second electron withdrawing ligand are independently selected from the group consisting of sulfonate ligands, sulfonimide ligands, carboxylate ligands, and β-diketonate ligands.

Examples of sulfonate ligands include $OSO_2R^1$, wherein $R^1$ is halo; substituted or unsubstituted $C_6$-$C_{18}$-aryl; substituted or unsubstituted $C_1$-$C_6$-alkyl; and substituted or unsubstituted $C_6$-$C_{18}$-aryl-$C_1$-$C_6$-alkyl and sulfonate ligands as described in PCT/US2016/018050.

Examples of sulfonimide ligands include $N(SO_3R^1)$, wherein $R^1$ is wherein $R^1$ is halo; substituted or unsubstituted $C_6$-$C_{18}$-aryl; substituted or unsubstituted $C_1$-$C_6$-alkyl; and substituted or unsubstituted $C_6$-$C_{18}$-aryl-$C_1$-$C_6$-alkyl and sulfonimide ligands as described in PCT/US2016/018050.

Examples of carboxylate ligands include ligands of the formula $R^1C(O)O$—, wherein $R^1$ is wherein $R^1$ is halo; substituted or unsubstituted $C_6$-$C_{18}$-aryl; substituted or unsubstituted $C_1$-$C_6$-alkyl; and substituted or unsubstituted $C_6$-$C_{18}$-aryl-$C_1$-$C_6$-alkyl and carboxylate ligands as described in PCT/US2016/018050.

Electron withdrawing ligands can also include —O(O)C—$R^2$—C(O)O— wherein $R^2$ is ($C_1$-$C_6$)-alkylenyl or ($C_3$-$C_6$)-cycloalkylenyl,

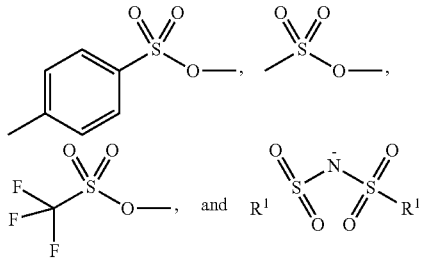

wherein $R^1$ is selected from the group consisting of F or $CF_3$.

In another aspect, the compositions and methods described herein include an electrolyte (e.g., Na, Li, K, Cs, perchlorate, sulfate, phosphate, nitrate, halides, organic sulfates, and organic sulfonates, amidosulfonate, hexafluorosilicate, tetrafluoroborate, methanesulfonate; and carboxylate). In yet another aspect, the concentration of the electrolyte is from about 0.01M to about 1M.

In another aspect, the compositions and methods described herein include a chelating agent (e.g., sodium bicarbonate, methanesulfonic acid, and organic carboxylate). In a further aspect, the concentration of the chelating agent is from about 0.01M to about 1M.

In another aspect, the pH of the composition is adjusted to between about 2 and about 5, or 3.8 to about 4.2.

In a further aspect, the ratio of the first metal complex to the second metal complex can be from about 0.1:1 to about 1:0.1. In another aspect, the ratio of the first metal complex to the second metal complex is about 1:1.

In another aspect, the first metal complex includes zirconium and the second metal complex includes aluminum. In yet another aspect, the concentration of the first metal complex is from about 0.01M to about 0.5M and the concentration of the second metal complex is from about 0.01M to about 0.5M. In a further aspect, the concentration of the first metal complex is 0.05M and the concentration of the second metal complex is 0.05M.

In yet another aspect, the compositions and methods described herein include an electrolyte and a chelating agent. The electrolyte and chelating agent can be the same or different.

In another aspect, the composition includes zirconium, aluminum, monobasic sodium citrate, and sodium methansulfonate. In one aspect, the concentration of zirconium can be from about 0.1M to 0.5M. In yet another aspect, the concentration of zirconium is about 0.05M.

In another aspect, the concentration of aluminum is from about 0.1M to 0.5M. In a further aspect, the concentration of aluminum is about 0.05M.

In another aspect, the concentration of the monobasic sodium citrate is from about 0.01M to about 1M. In yet another aspect, the concentration of the monobasic sodium citrate is about 0.05M.

In another aspect, the concentration of the sodium methansulfonate is from about 0.01M to about 1M. In yet another aspect, the composition of claim 35, wherein the concentration of the sodium methansulfonate is about 0.4M.

Further aspects provide a composition comprising zirconium and aluminum oxide. In this aspect, the concentration of zirconium in the composition is from about 1 to about 20%. In another aspect, the concentration of zirconium in the composition is about 50%, and the concentration of aluminum oxide in the composition is about 50%

In a further aspect, methods of electrodepositing at least one reactive metal onto a surface of a conductive substrate are provided. In this aspect, a first metal complex comprising zirconium, and a second metal complex comprising aluminum are electrochemically reduced. The first metal complex and the second metal complex can be dissolved in a substantially aqueous medium wherein at least a first layer of zirconium is deposited onto the surface of the conductive substrate.

It should be understood that compositions, methods, and kits described herein can be used to deposit a single layer or multiple layers of one or more reactive metals depending on the conditions used (e.g., current density applied). For example, a single layer zirconium can be deposited from a mixed reactive metal solution. A first layer of a first reactive metal (e.g., zirconium) can be deposited followed by one or more layers of a second reactive metal (e.g., aluminum). It should also be understood that the initial layer of the first reactive metal can be electrodeposited on to a conductive substrate followed by electroprecipitation of a second reactive metal on to the initial layer.

In one aspect, at least a first layer of aluminum is deposited onto the first layer of zirconium. In another aspect, the electrochemical reduction is carried out in an atmosphere substantially comprising oxygen (e.g., greater than 50% oxygen). The electrochemical reduction can be carried out at a temperature of about 10° C. to about 40° C. In yet another aspect, the pH of the substantially aqueous medium is from about 2 to about 5.

In one aspect, the conductive substrate comprises carbon, conductive glass, conductive plastic, steel, copper, aluminum, or titanium. In another aspect, when the substrate is aluminum, methods and compositions disclosed herein can be used for repair of an anodized surface. Coated copper substrates can be used as a corrosion resistant conductive substrate or thermal barrier. Titanium can be used as a steel coating substrate for biocompatibility applications or as electrochemical sensors. Stainless steel substrates coated with titanium or zirconium can be used for conductivity applications. Aluminum or zirconium coatings can be used on conductive plastic substrates for decorative applications.

In yet another aspect, a current density from about 5 to about 250 mA/cm$^2$ or about 7 to about 200 mA/cm$^2$ can be used. The current can be applied for a suitable period of time (e.g., at least about 30 minutes, 60 minutes, 120 minutes).

Further aspects provide a kit for electrodepositing at least one reactive metal onto a surface of a conductive substrate. In this aspect, the kit includes a solution of zirconium metal complex and a solution of aluminum metal complex. Each of the zirconium metal complex and aluminum metal complex can includes a metal (Zr or Al) and an electron withdrawing ligand as described herein (e.g., sulfonate ligands, sulfonimide ligands, carboxylate ligands, and β-diketonate ligands). In one aspect, the electron withdrawing ligand is methanesulfonic acid.

The concentration of zirconium in the zirconium metal complex can be at least about 4M. The concentration of aluminum in the aluminum metal complex can be at least about 2M.

The kit can also include an electrolyte solution including an electrolyte (e.g., Na, Li, K, Cs, perchlorate, sulfate, phosphate, nitrate, halides, organic sulfates, and organic sulfonates, amidosulfonate, hexafluorosilicate, tetrafluoroborate, methanesulfonate; and carboxylate).

In another aspect, the kit includes a chelating solution comprising a chelating agent (e.g., sodium bicarbonate, methanesulfonic acid, and organic carboxylate)

EXAMPLES

The following examples are illustrative and do not limit aspects described herein.

Example 1—Voltage for Observed Mass Change

FIG. 1 is a Dynamic EQCM trace showing cyclic voltammograms over 3 cycles (solid line) with concurrent mass change via EQCM frequency (broken line) where $\Delta f = -Cf \cdot \Delta m$ to determine mass change using cyclic voltammetry collected at 10 mV/s on a gold electrode, with a platinum counter electrode and a silver/silver chloride reference. The solution used in this example was a 3 mL volume of 0.2M Zr(LS), 0.2M Al(LS) and 0.28M $NaClO_4$ at pH 2.44.

This example shows zirconium, aluminum electroplating in aqueous solutions. In this case, the application of a reducing voltage on the gold EQCM working electrode caused a mass change demonstrating the deposition process. As shown in FIG. 1, a cyclic voltammogram at 1 mV/s is completed while the mass change by EQCM is simultaneously monitored. As the reduction event commences at ca. −0.8V (vs. Ag/AgCl), a mass change is not observed until about −1.1V (vs. Ag/AgCl). In addition, much lower gas evolution was observed compared to Zr or Al individually.

Example 2—Mass Change at Increasing Voltage

Figure 2:
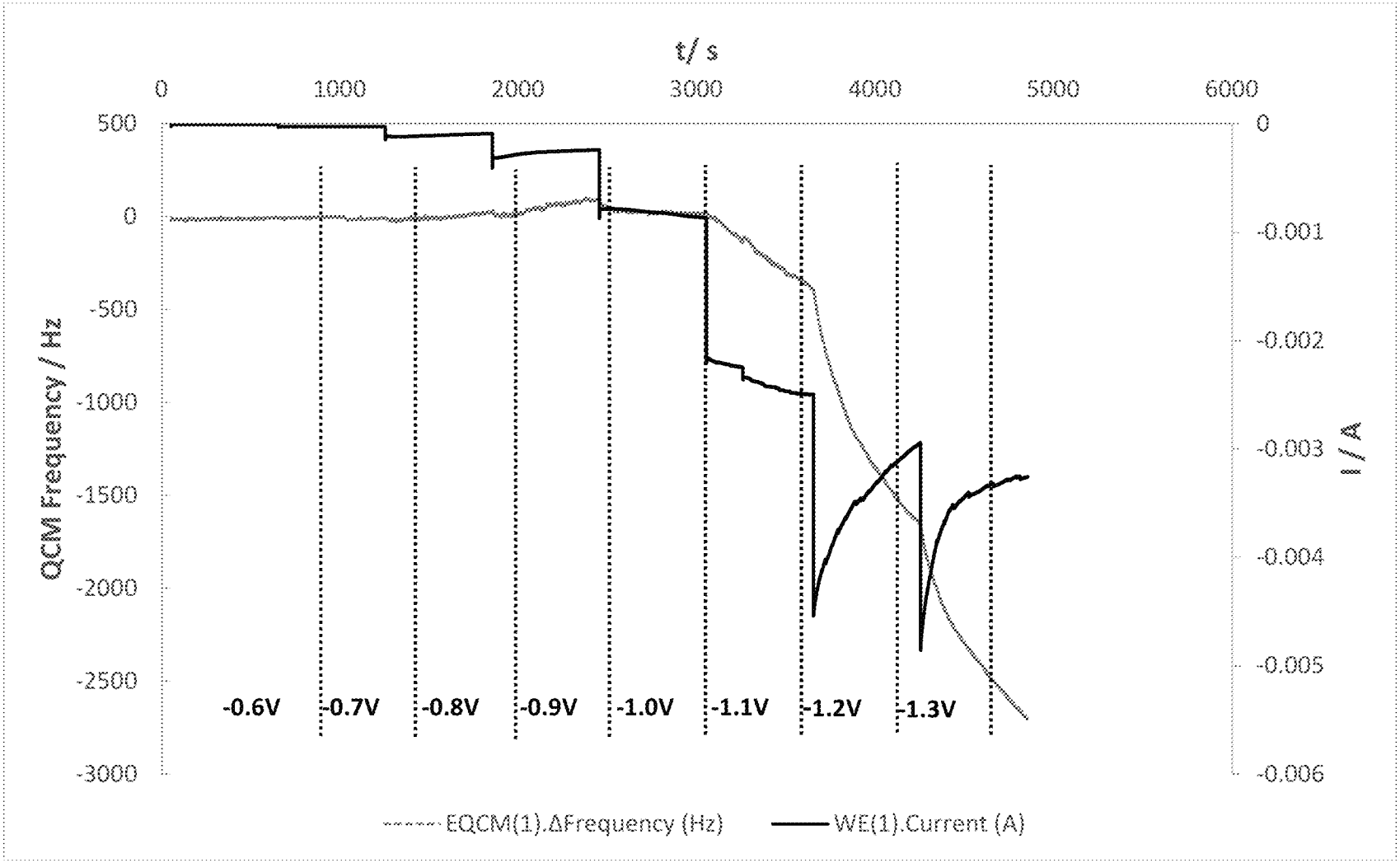
FIG. 2 shows the results of an exemplary potentiostatic EQCM test for electrodeposition of the indicated metal under increasing voltage (vs. Ag/AgCl) with data collected on a gold electrode, with a platinum counter electrode, and a silver/silver chloride in 3 mL of 0.2M Zr(LS), 0.2M Al(LS) and 0.28M $NaClO_4$ at pH 2.44.

FIG. 2 shows Potentiostatic EQCM testing for increasing voltages (vs. Ag/AgCl). The grey line shows the current response upon application of each voltage level (indicated at the bottom of each segment). In this example, each voltage is applied for 10 minutes before stepping in 0.1V increments to more negative voltage over a range of −0.6V to −1.3V.

Concurrently the mass change via EQCM frequency is measured (black line) where $\Delta f = -Cf \cdot \Delta m$ to determine mass change. Data was collected on a gold electrode, with a platinum counter electrode and a silver/silver chloride reference. The solution was a 3 mL volume of 0.2M Zr(LS), 0.2M Al(LS) and 0.28M $NaClO_4$ at pH 2.44.

In this example, mass change is monitored as the voltage (deposition driving force) gradually increased. Mass change is observed at about −1.1V which is at a lower voltage than is theoretically possible for either zirconium or aluminum deposition. The observed mass change is roughly linear, indicating electrochemical rather than a pure precipitation mechanism. At higher voltage, a more rapid mass change is indicated, showing an increase in deposition rate.

Example 3—EQCM and XPS at Increasing Current Density

Figure 3:
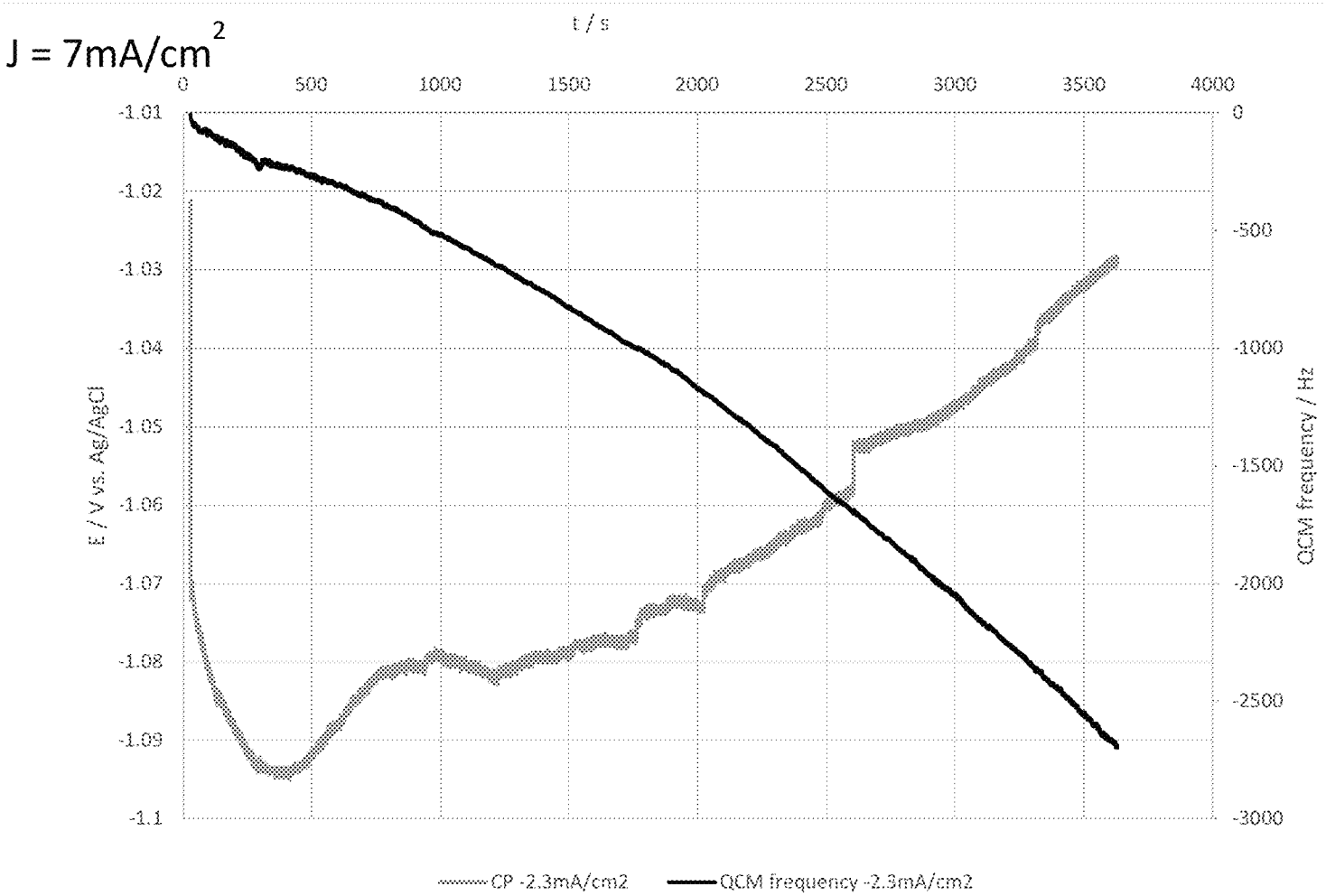
FIG. 3 shows the results of exemplary galvanostatic testing for EQCM mass change resulting from electrodeposited metal at an applied constant current density of 7 $mA/cm^2$ with data collected on a gold electrode, with a platinum counter electrode, and a silver/silver chloride reference in 3 mL of 0.2M Zr(LS), 0.2M Al(LS) and 0.28M $NaClO_4$ at pH 2.44.

FIG. 3 shows Galvanostatic testing for EQCM mass change at an applied current density of 7 mA/cm$^2$. A constant current density is applied to the solution and voltage variation (vs. Ag/AgCl) is measured (grey line) concurrently with mass change via EQCM frequency is measured (black line) where $\Delta f = -Cf \cdot \Delta m$ to determine mass change. Data was collected on a gold electrode, with a platinum counter electrode and a silver/silver chloride reference. The solution was a 3 mL volume of 0.2M Zr(LS), 0.2M Al(LS) and 0.28M $NaClO_4$ at pH 2.44.

As shown in FIG. 3, an initial layer is formed at very low current density (i.e., 7 mA/cm$^2$) with a voltage corresponding to the initial deposition shown in FIGS. 1 and 2 (i.e., about −1.1V).

Figure 4:
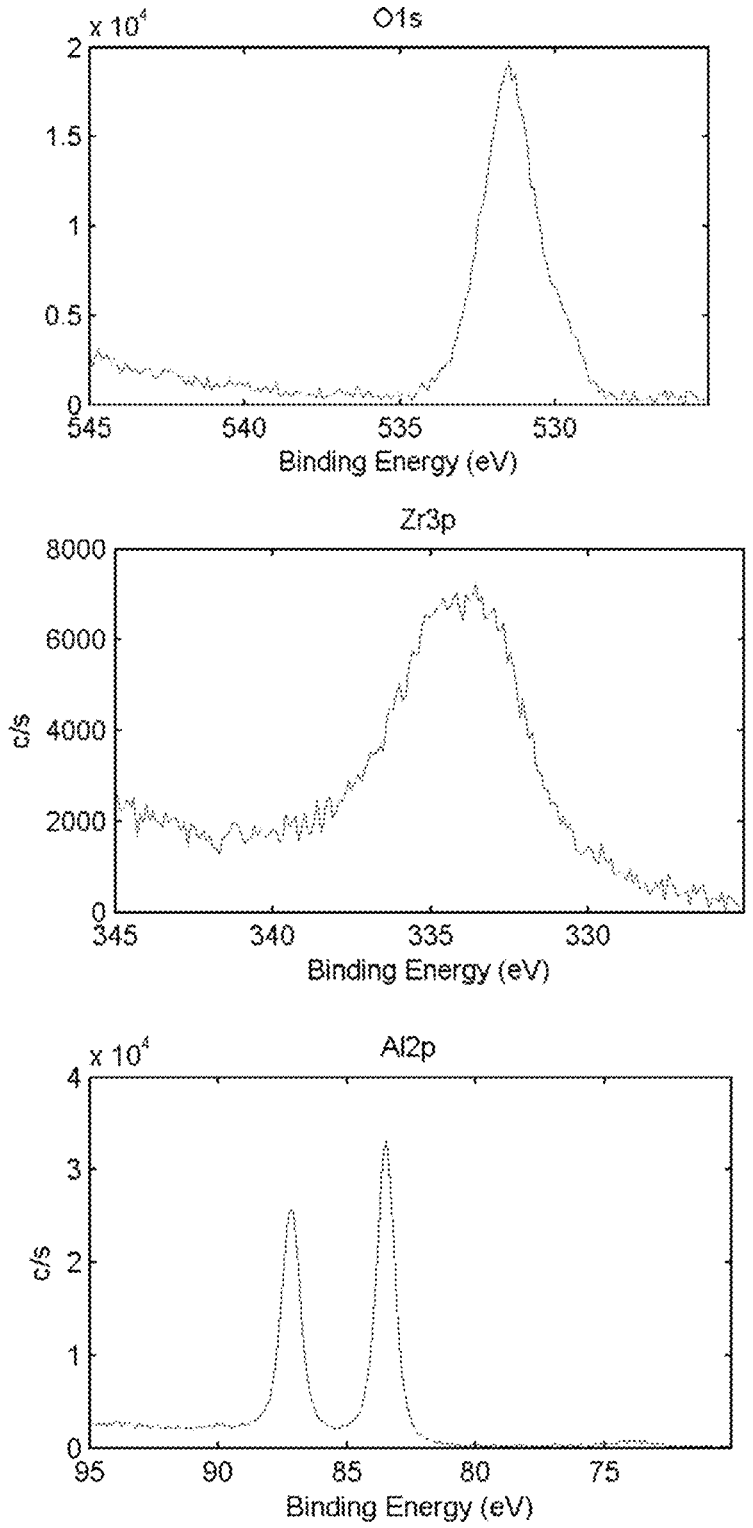
FIG. 4 provides exemplary x-ray photoelectron spectroscopy (XPS) data for the gold surface after application of 7 $mA/cm^2$ current density for 1 hour with separate traces for the O1s (left), Zr3p (center) and Al2p (right) regions shown.

FIG. 4 provides X-Ray photoelectron Spectroscopy (XPS) data for the gold surface after application of 7 mA/cm$^2$ current density for 1 hour. Separate traces for the O1s (left), Zr3p (center) and Al2p (right) regions are shown. A summary table is given showing the atomic percentage composition of the surface layer is provided below:

TABLE 1

| XPS Summary at 7 mA/cm$^2$ XPS summary: | | | |
|---|---|---|---|
| | O1s | Al2p | Zr3p |
| Atomic % | 49.31 | 6.47 | 44.22 |

J = 7 mA/cm$^2$

In this example, the initial layer is predominantly Zr and very metallic in nature. The layer is formed at lower voltage that theoretically possible for Zr deposition as hydroxide or free ion as shown below:

$$ZrO_2+4H^++4e \rightleftharpoons Zr+2H_2O \quad -1.553$$

$$ZrO(OH)_2+H_2O+4e \rightleftharpoons Zr+4OH^- \quad -2.36$$

$$Zr^{4+}+4e \rightleftharpoons Zr \quad -1.45$$

Figure 5:
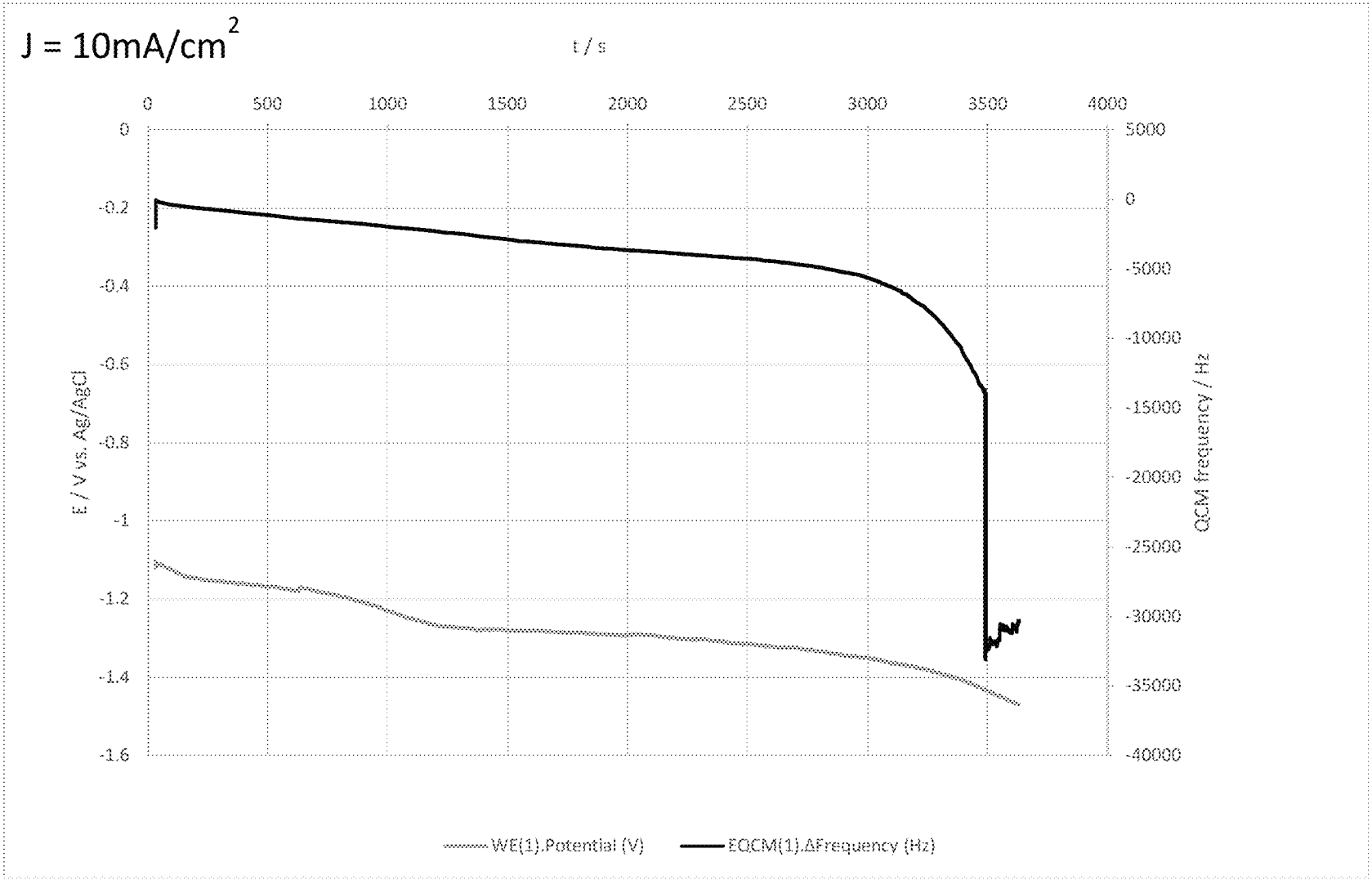
FIG. 5 shows the results of exemplary galvanostatic testing for EQCM mass change resulting from electrodeposited metal at an applied constant current density of 10 $mA/cm^2$ with data collected on a gold electrode, with a platinum counter electrode, and a silver/silver chloride reference in 3 mL of 0.2M Zr(LS), 0.2M Al(LS) and 0.28M $NaClO_4$ at pH 2.44.
Figure 6:
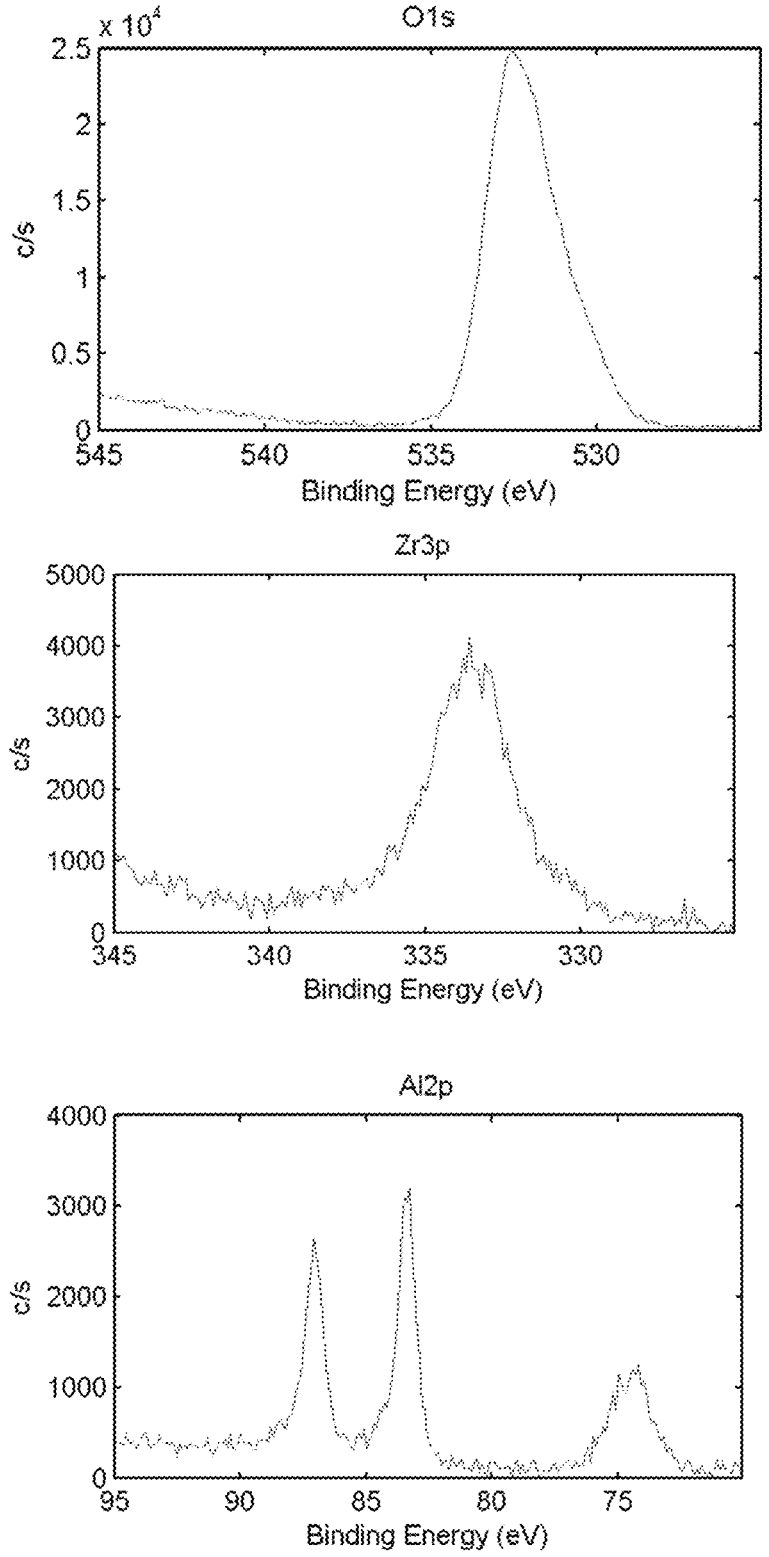
FIG. 6 provides exemplary x-ray photoelectron spectroscopy (XPS) data for the gold surface after application of 10 $mA/cm^2$ current density for 1 hour with separate traces for the O1s (left), Zr3p (center) and Al2p (right) regions shown.

FIGS. 5 (EQCM) and 6 (XPS) show the results of the same experiment described with respect to FIGS. 3 and 4 using a current density of 10 mA/cm$^2$ for 1 hour. Table 2 below provides the summary data for the XPS analysis:

TABLE 2

| XPS Summary at 10 mA/cm$^2$ XPS summary: | | | |
|---|---|---|---|
| | O1s | Al2p | Zr3p |
| Atomic % | 60.79 | 11.25 | 27.96 |

At a current density of 10 mA/cm$^2$, growth of the deposited layer is still mostly linear and more balanced for Zr and Al. The deposited layer is less metallic in character with a higher growth rate.

Figure 7:
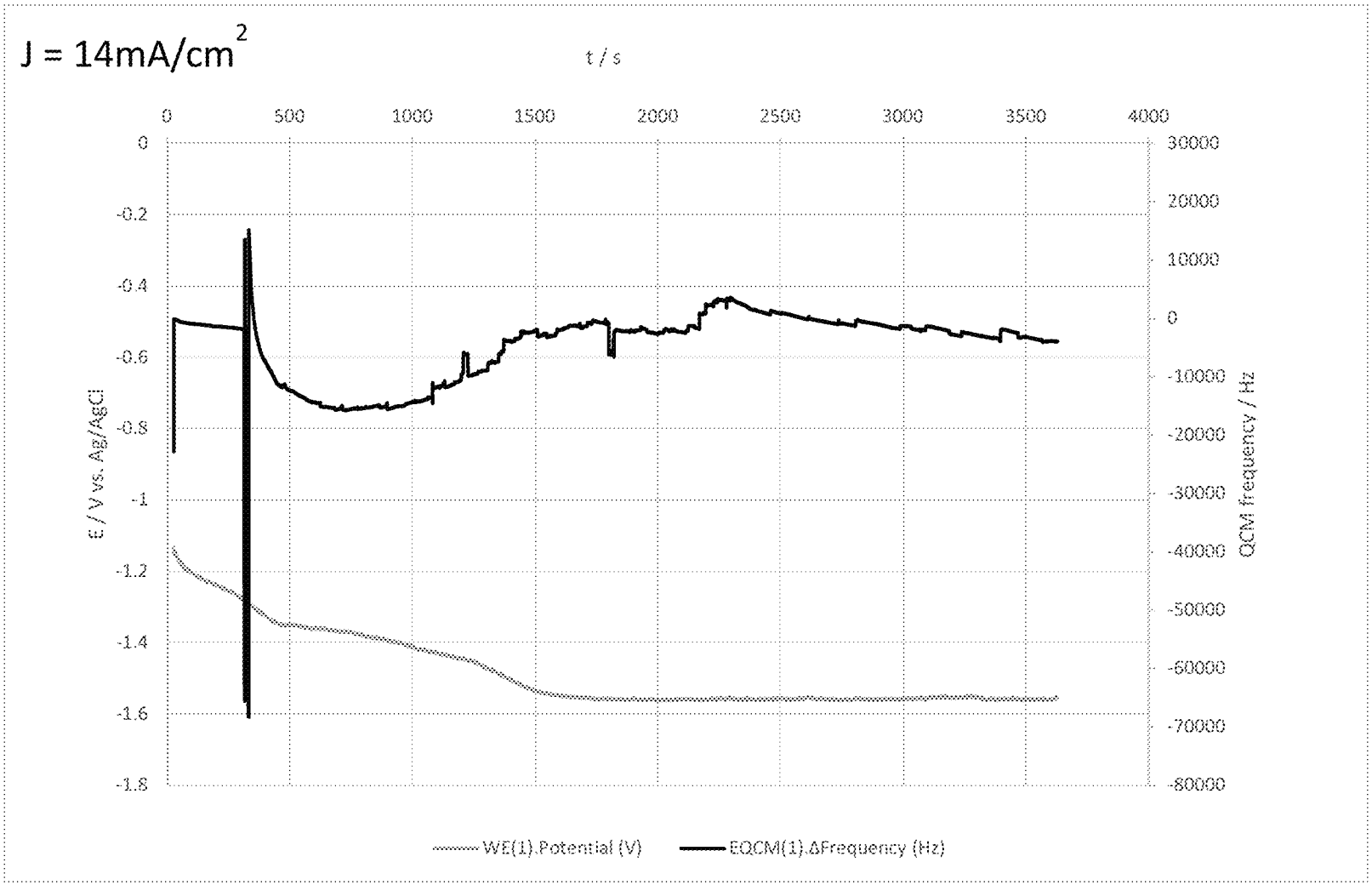
FIG. 7 shows the results of exemplary galvanostatic testing for EQCM mass change resulting from electrodeposited metal at an applied constant current density of 14 $mA/cm^2$ with data collected on a gold electrode, with a platinum counter electrode, and a silver/silver chloride reference in 3 mL of 0.2M Zr(LS), 0.2M Al(LS) and 0.28M $NaClO_4$ at pH 2.44.
Figure 8:
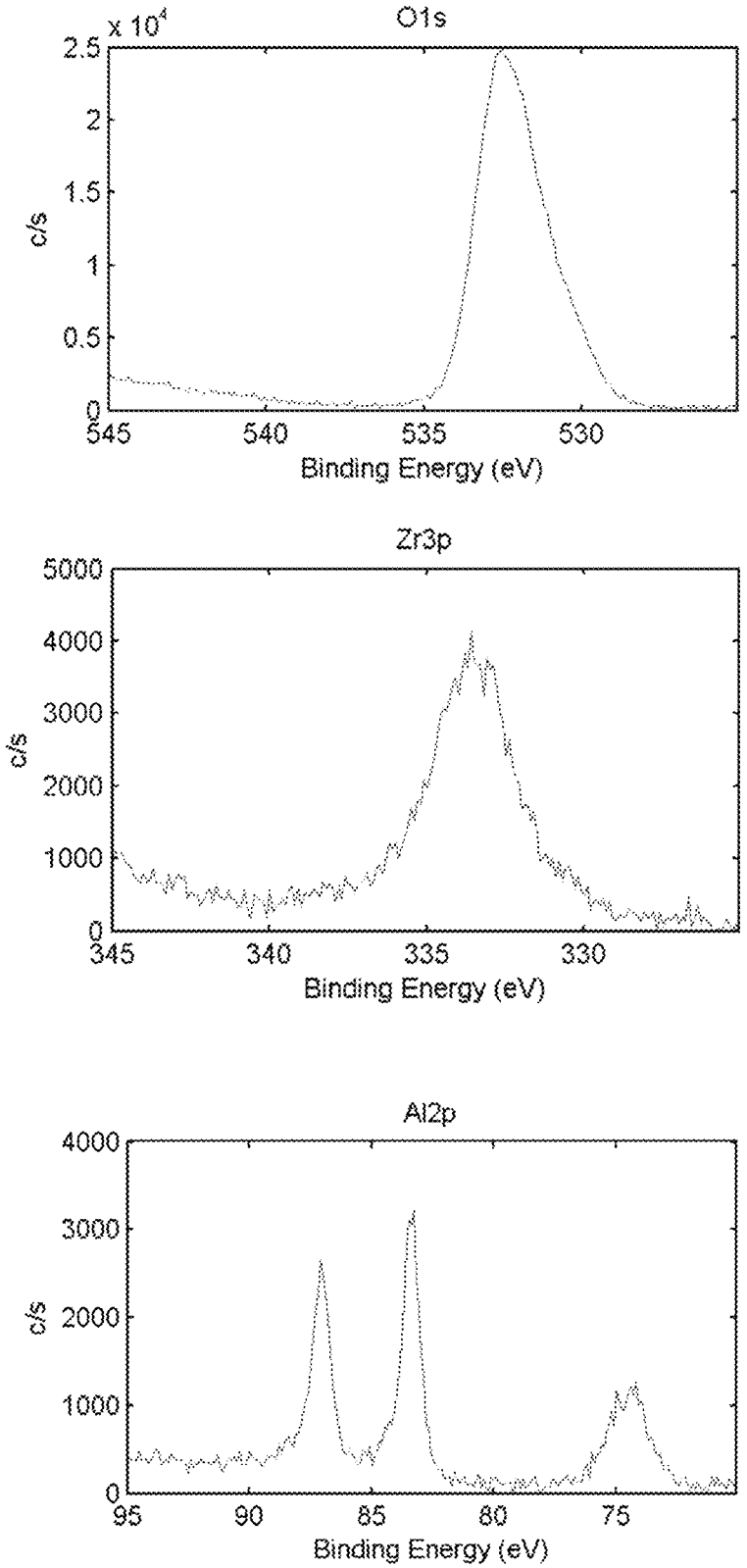
FIG. 8 provides exemplary x-ray photoelectron spectroscopy (XPS) data for the gold surface after application of 14 $mA/cm^2$ current density for 1 hour with separate traces for the O1s (left), Zr3p (center) and Al2p (right) regions shown.

FIGS. 7 (ECQM) and 8 (XPS) show the results of the same experiment described with respect to FIGS. 3-6 using a current density of 14 mA/cm$^2$ current density for 1 hour. Table 2 below provides the summary data for XPS:

TABLE 3

| XPS Summary at 14 mA/cm$^2$ XPS summary: | | | |
|---|---|---|---|
| | O1s | Al2p | Zr3p |
| Atomic % | 79.87 | 14.40 | 5.73 |

At a current density of 14 mA/cm$^2$, the deposited layer has a faster growth rate with less Zr. The oxide is predominantly formed in this example with greater gas generation due to water splitting.

As shown in the overall XPS summary below, Zr deposition is favored at lower current density. In addition, the metallic character of the deposited layer is lower as the current density is increased.

TABLE 4

| Overall XPS Summary | | | |
|---|---|---|---|
| | O1s | Al2p | Zr3p |
| 7 mA/cm$^2$ | 49.31 | 6.47 | 44.22 |
| 10 mA/cm$^2$ | 60.79 | 11.25 | 27.96 |
| 14 mA/cm$^2$ | 79.87 | 14.40 | 5.73 |

Example 4—Comparison to Single Metal (Zr) Electrodeposition

Figure 9:
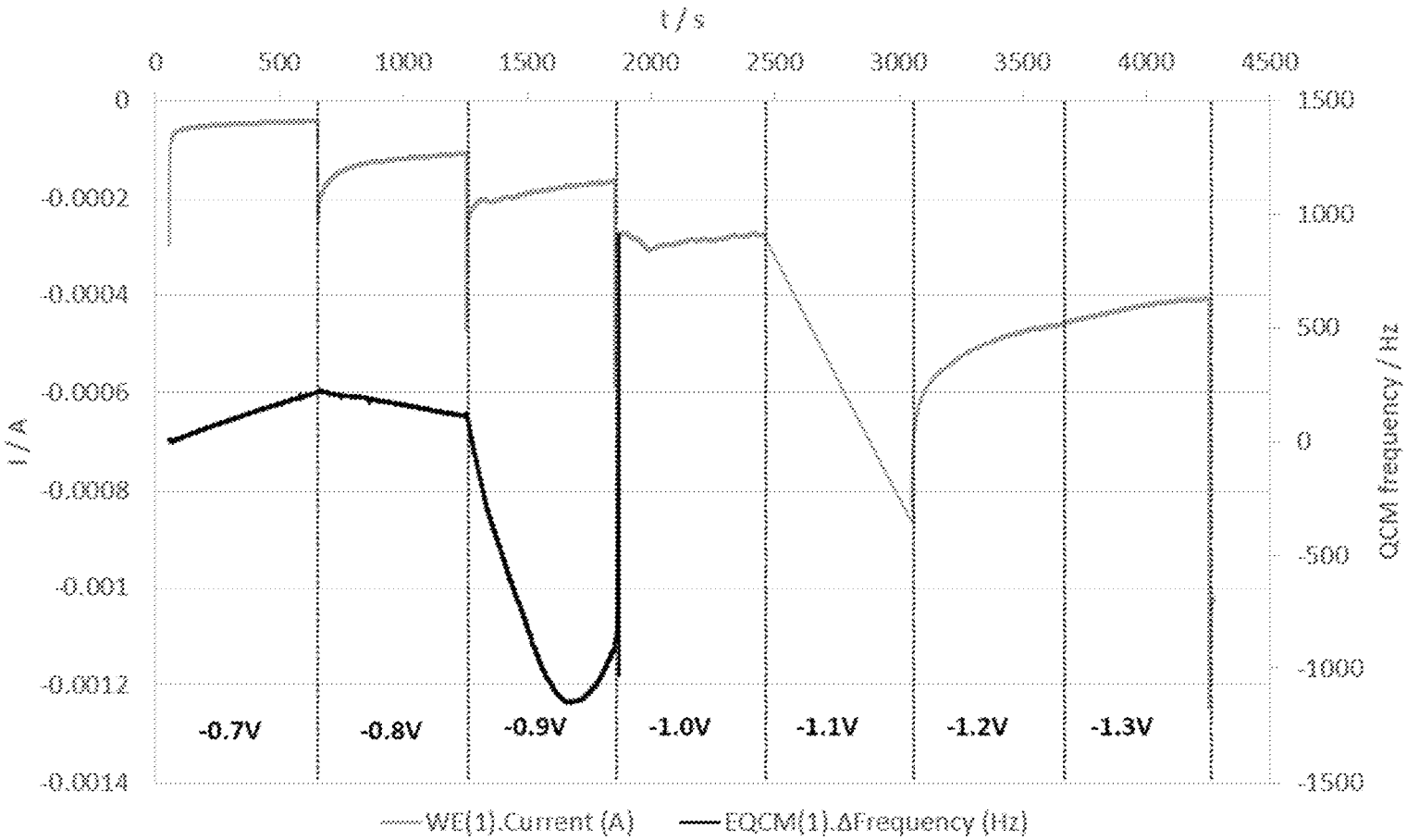
FIG. 9 shows the results of an exemplary potentiostatic EQCM test for mass change resulting from electrodeposited metal after application of increasing voltages (vs. Ag/AgCl), with the grey line showing the current response upon application of each voltage level (indicated at the bottom of each segment) with data collected on a gold electrode, with a platinum counter electrode and a silver/silver chloride reference in a 3 mL solution of 0.22M Zr(LS) and 0.28M $NaClO_4$ at pH 2.02.

FIG. 9 shows Potentiostatic EQCM testing for increasing voltages (vs. Ag/AgCl). The grey line shows the current response upon application of each voltage level (indicated at the bottom of each segment). Each voltage is applied for 10 minutes before stepping in 0.1V increments to more negative voltage over a range of −0.7V to −1.3V. Concurrently the mass change via EQCM frequency is measured (black line) where $\Delta f=-Cf\cdot\Delta m$ to determine mass change. Data collected on a gold electrode, with a platinum counter electrode and a silver/silver chloride reference. The solution was a 3 mL volume of 0.22M Zr(LS) and 0.28M $NaClO_4$ at pH 2.02.

Figure 10:
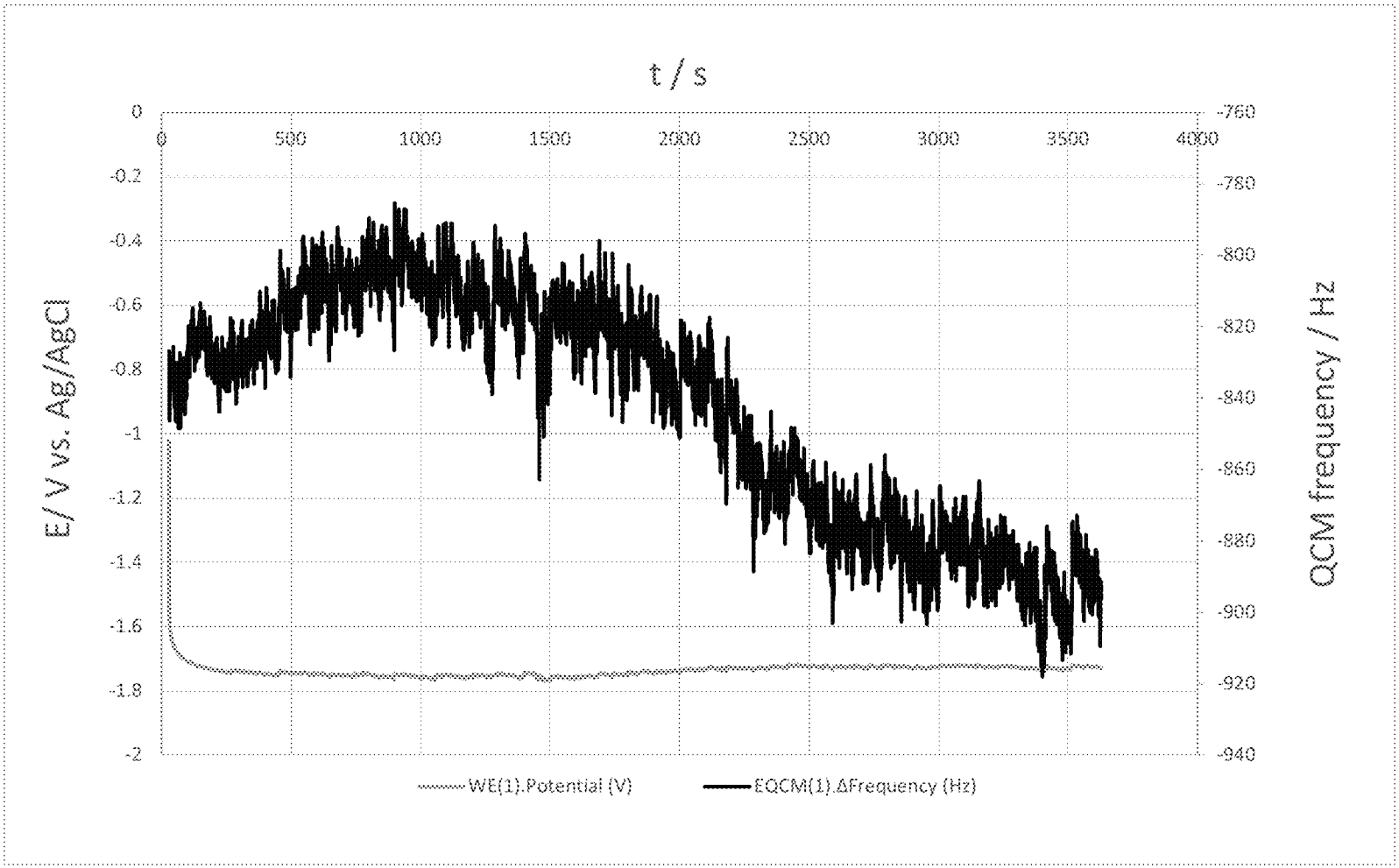
FIG. 10 shows the results of exemplary galvanostatic testing for EQCM mass change resulting from electrodeposited metal at an applied current density of 10 $mA/cm^2$ voltage variation (vs. Ag/AgCl) measured (grey line) concurrently with mass change with data collected on a gold electrode, with a platinum counter electrode and a silver/silver chloride reference in a 3 mL solution of 0.22M Zr(LS) and 0.28M $NaClO_4$ at pH 2.02.

FIG. 10 shows Galvanostatic testing for EQCM mass change at an applied current density of 10 mA/cm$^2$. A constant current density is applied to the solution and voltage variation (vs. Ag/AgCl) is measured (grey line) concurrently with mass change via EQCM frequency is measured (black line) where $\Delta f=-Cf\cdot\Delta m$ to determine mass change. Data was collected on a gold electrode, with a platinum counter electrode and a silver/silver chloride reference. The solution was a 3 mL volume of 0.22M Zr(LS) and 0.28M $NaClO_4$ at pH 2.02.

With no Al, no stable linear deposition growth is shown at any voltage. No layer is detected even at a current density of 10 mA/cm$^2$.

Example 5—Morphology

Figure 11A:
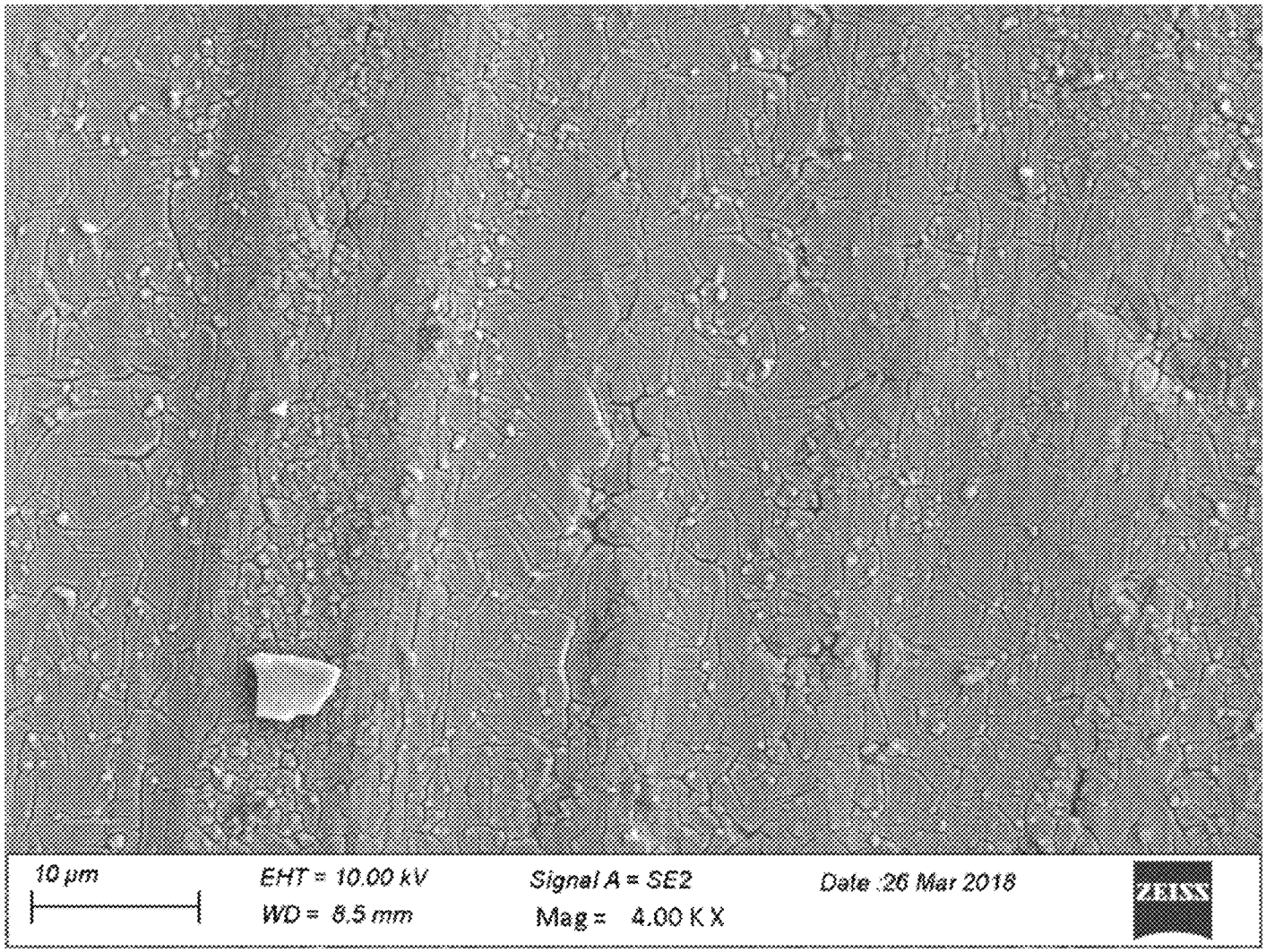
FIGS. 11A-11D show scanning electron micrograph (SEM) images of site I of a mild steel plate treated with an exemplary zirconium electroplating system exposed to a solution of 0.05M Al(LS), 0.05M Zr(LS) and 0.1M Na Citrate at a pH of 4.45 with a current density of 200 $mA/cm^2$ for 1 hour using an on/off pulse of 100 ms on, 100 ms off with an anode to cathode ratio of 1:1, and a temperature of 20° C. at the indicated magnification levels (FIGS. 11A-11C) and a standard image (FIG. 11D)
Figure 11B:
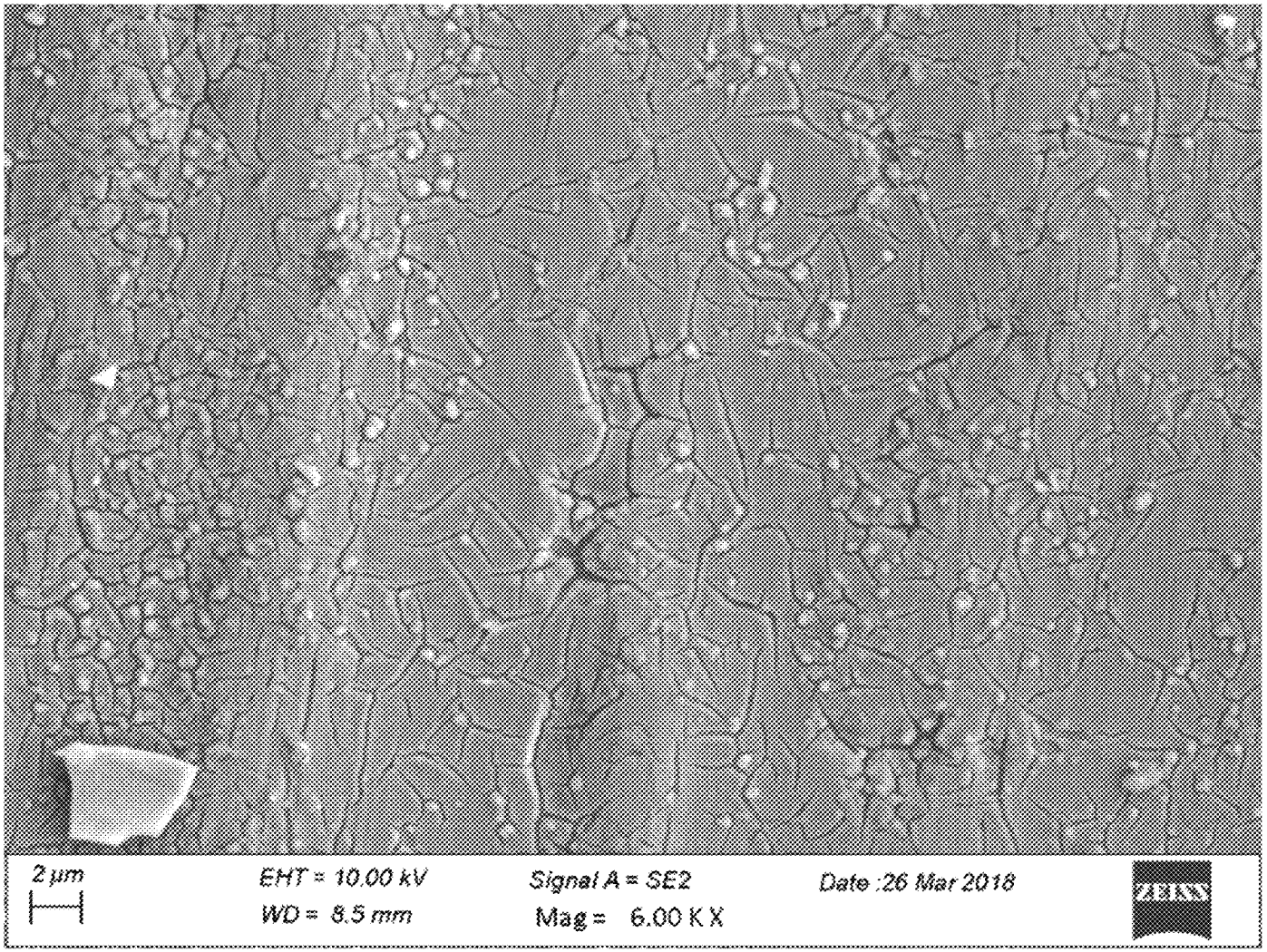
Figure 11C:
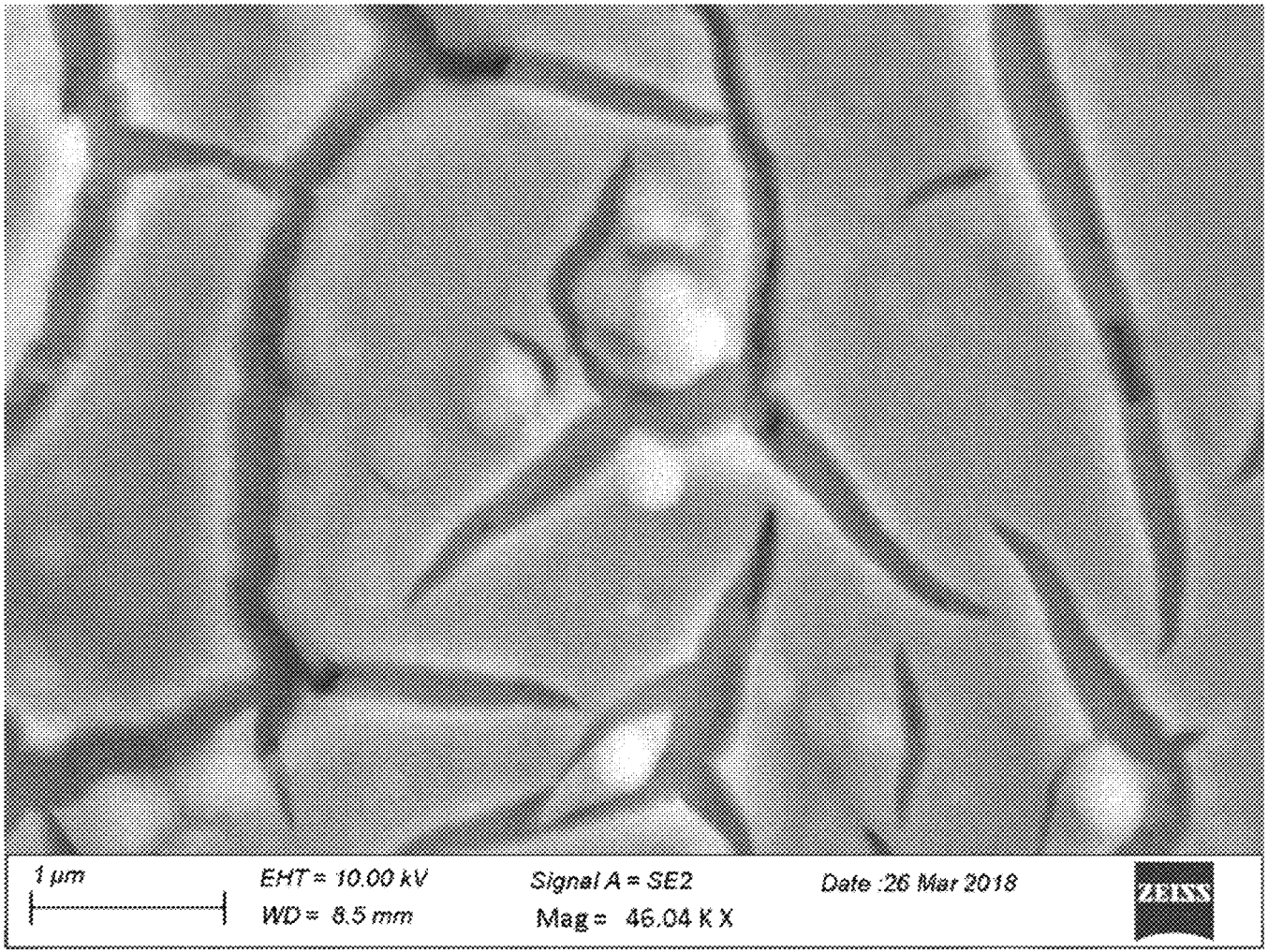
Figure 11D:
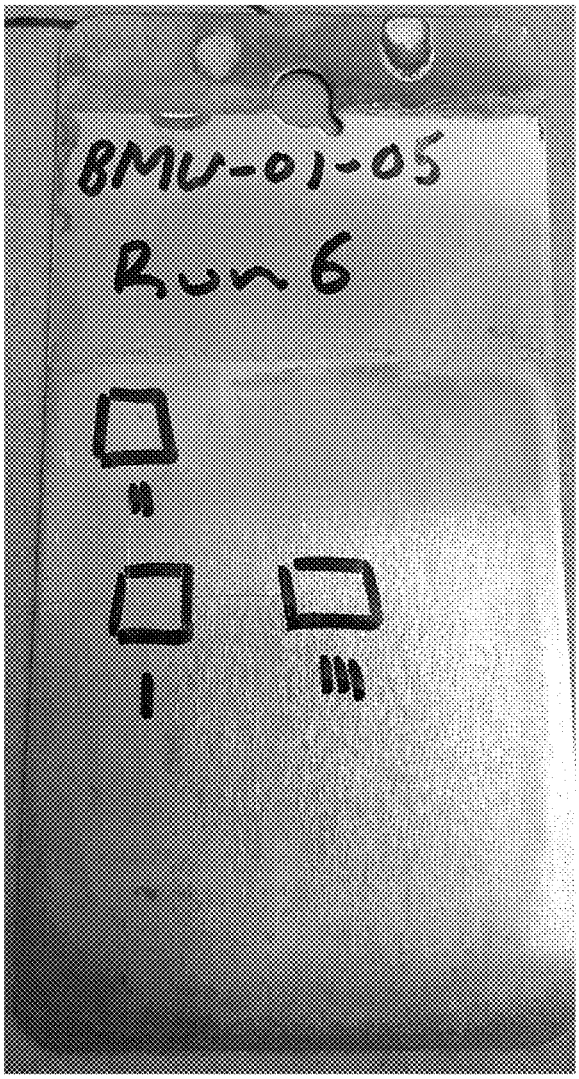

FIGS. 11A-11C show visual SEM images of a mild steel plate treated with mixed zirconium/aluminum electroplating system for site I as indicated in the images at magnification level of ×4000 (11A), ×6000 (11B) and ×46000 (11C) taken at an accelerating voltage of 10 kV. The plate was exposed to a solution of 0.05M Al(LS), 0.05M Zr(LS) and 0.1M Na Citrate at a pH of 4.45. The plating conditions were 200 mA/cm$^2$ for 1 hour using a simple on/off pulse of 100 ms on, 100 ms off with an anode to cathode ration of 1:1 and a temperature of 20° C. FIG. 11D shows three sites on the steel plate.

As shown in FIGS. 11A-11C, the plate center has thin, dense, plate-like growth of the deposition layer. The growth in conformal to defects with nucleation sites visible as nodules.

Figure 12A:
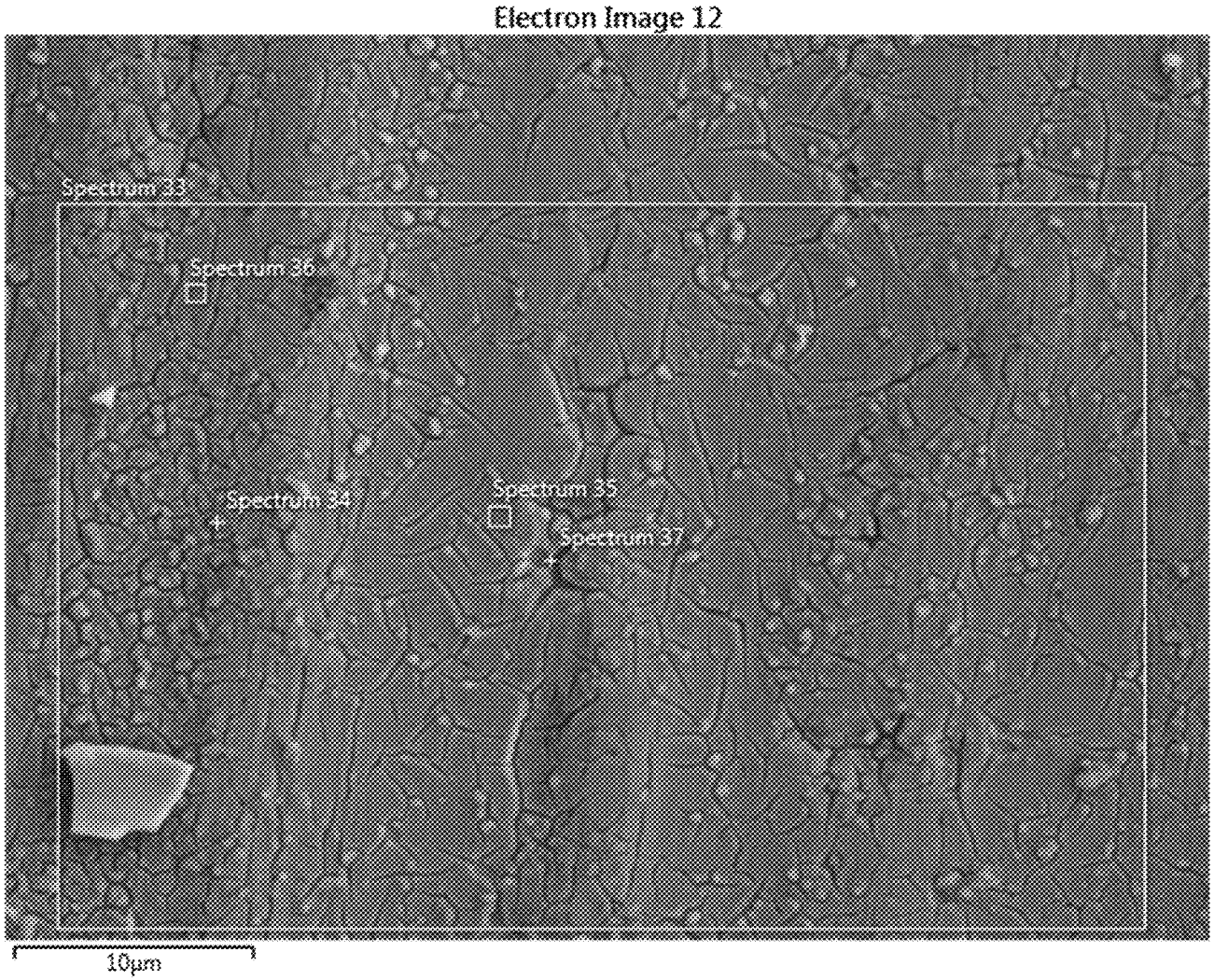
FIGS. 12A-12B shown an SEM image for site I as indicated in the images at a magnification of ×4000 at an accelerating voltage of 10 kV (FIG. 12A) and an EDX (energy-dispersive X-ray spectroscopy) spectra were collected at each area indicated on the SEM (FIG. 12B)
Figure 12B:
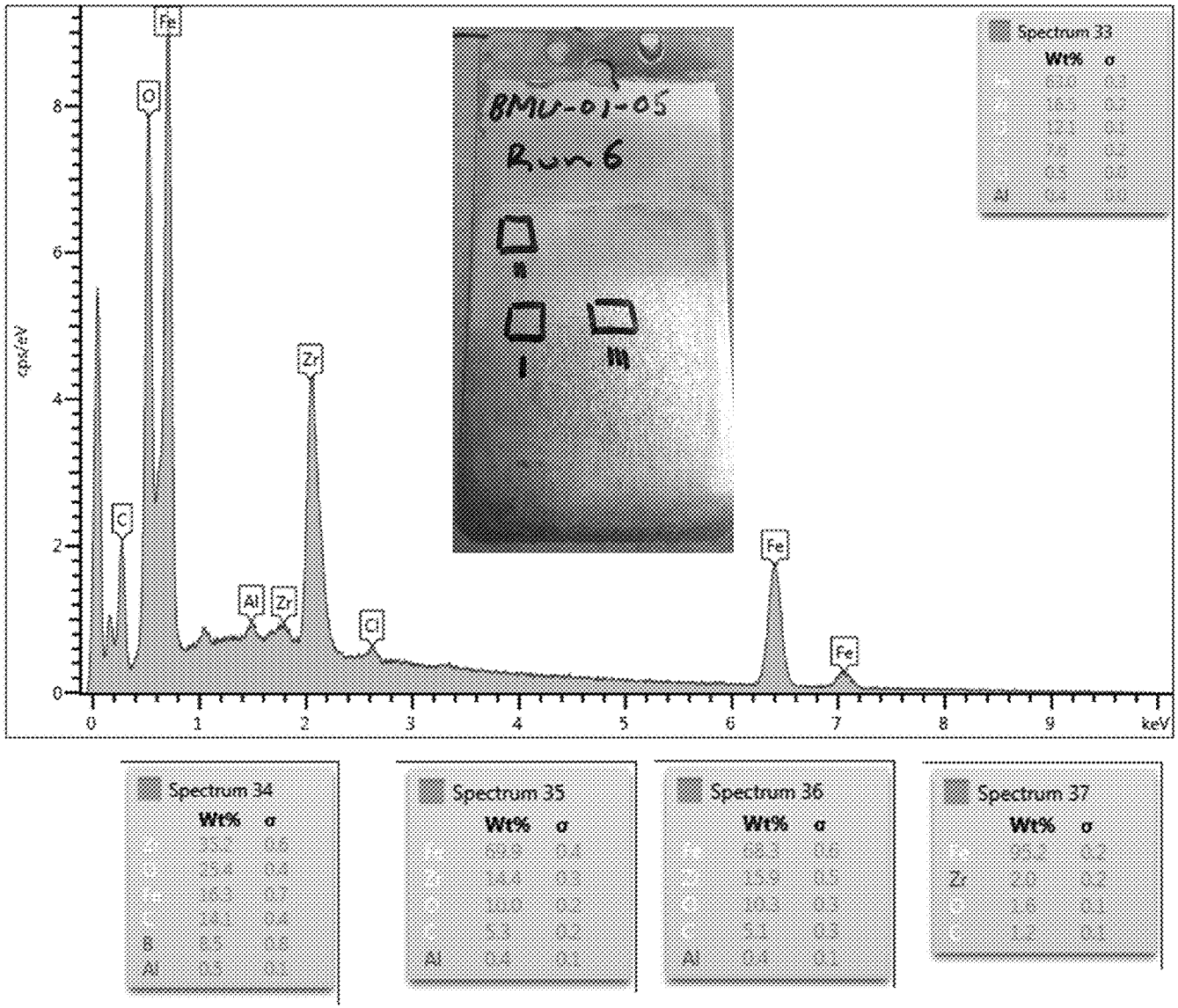

FIG. 12A shows an SEM image for site I, as indicated, at a magnification of ×4000 with an accelerating voltage of 10 kV. FIG. 12B provides the EDX spectra collected at each area indicated on the SEM. The EDX spectra shown is a wide scan of the entire SEM region. The indicated spectra show components in wt %. The cracked area is Zr rich and not the steel. The growth sites are very Zr rich with heavy metallic character. Very little Al is observed.

Figure 13A:
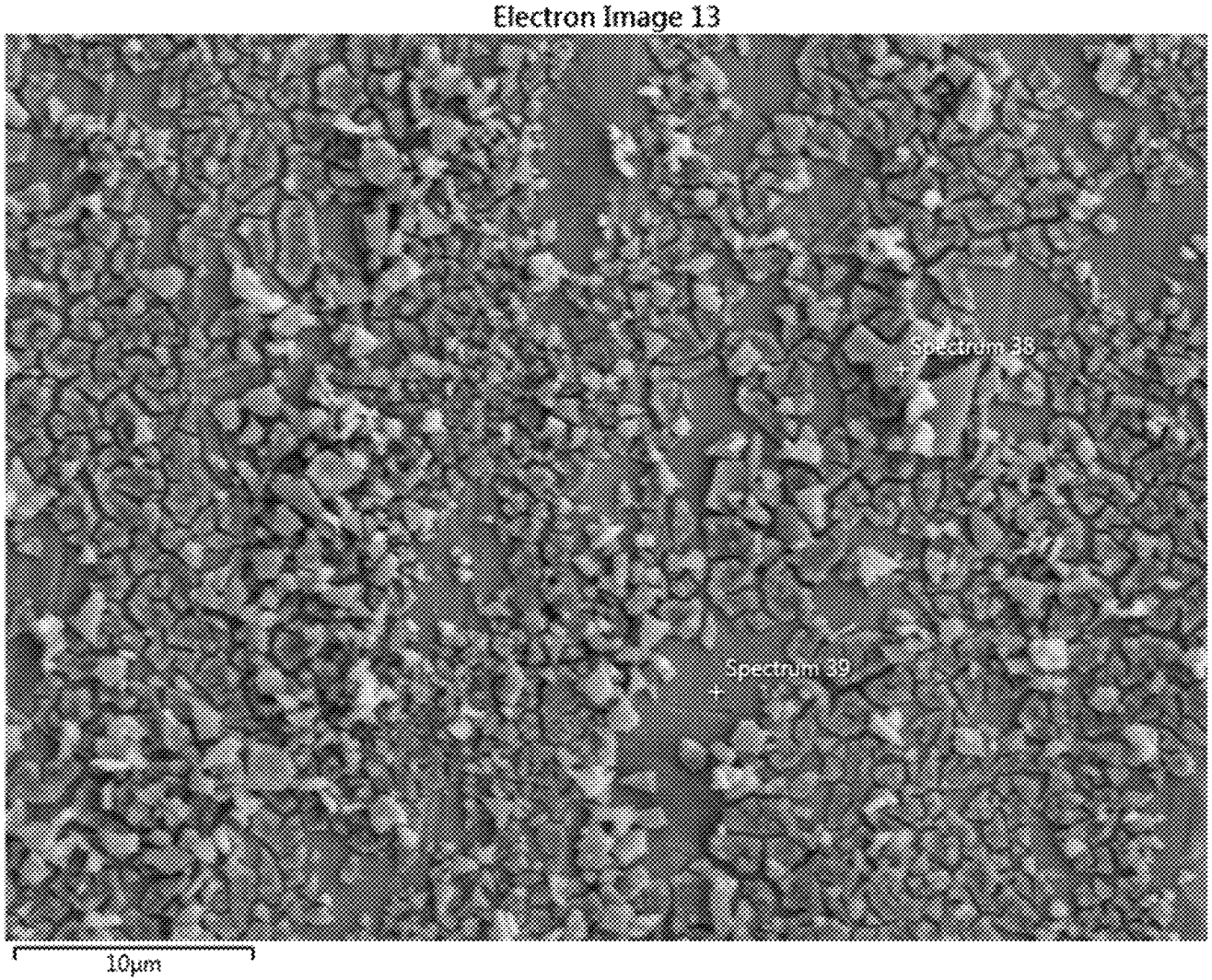
FIGS. 13A-13B shown an SEM image for site II as indicated in the images at a magnification of ×4000 at an accelerating voltage of 10 kV (FIG. 13A) and an EDX (energy-dispersive X-ray spectroscopy) spectra were collected at each area indicated on the SEM (FIG. 13B).
Figure 13B:
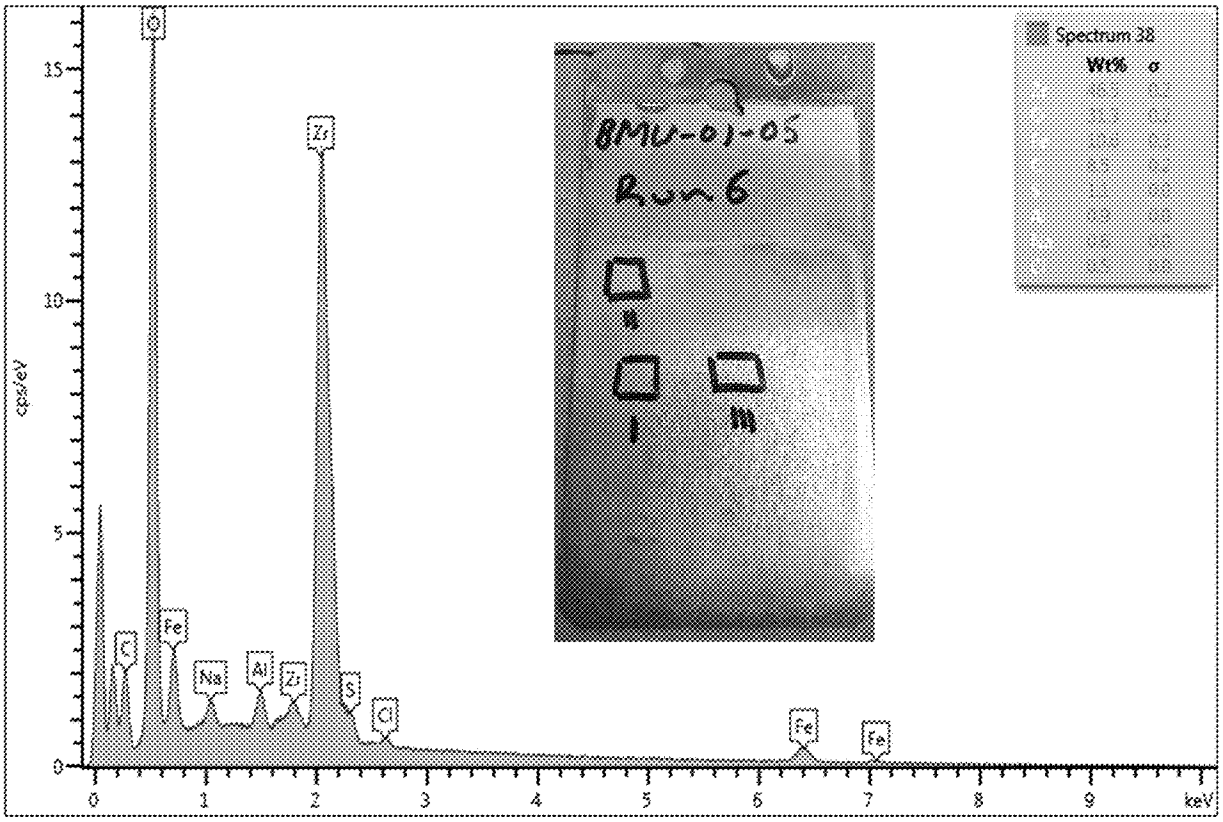
Figure 13B:
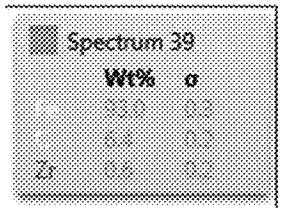

FIG. 13A shows an SEM image for site II, as indicated, at a magnification of ×4000 with an accelerating voltage of 10 kV. EDX spectra were collected at each area indicated on the SEM. The representative EDX spectra shown is site 38. The indicated spectra show components in wt %. Here, the base steel is visible with a thicker Zr layer that is heavily cracked. Very little Al is observed.

Example 6—Making Al and Zr Concentrate

To make 3.81 L of 2M aluminum concentrate, 892.6 g aluminum carbonate was added to a 5 L flask with ca. 2 L DI (deionized) water with stirring to provide a suspension.

733.2 g methanesulfonic acid was added to a 500 mL addition funnel. The methanesulfonic acid was added dropwise while stirring for over 2 hours. The reaction is exothermic, and evolves a large volume of gas during reaction. After 3 hours, the solution changed from a white slurry to a light brown viscous liquid. The solution was further stirred overnight to ensure complete reaction.

To make 2 L of 4M zirconium concentrate, 768.8 g of methanesulfonic acid was added to a 4 L beaker and stirred. The beaker was chilled using an ice bath prior to reaction. 1161.8 g zirconium carbonate was added portion-wise to the beaker while stirring and maintaining a cold temperature. Initially, a large amount of gas evolved as the zirconium salt is made. Addition of zirconium is completed over a 4 hour period. A slightly brown, viscous liquid was formed. The resulting solution was stirred overnight to ensure complete reaction.

Example 7—Plating

Bath Generation

The plating bath for a 2 L scale operation is as follows. 200 mL of a 1M solution of citric acid and an equivalent of sodium hydroxide as a 1M solution to form mono basic sodium citrate was added to a 2 L beaker. Next, 402.3 mL of a 2M solution of Na(OMs) and 1 L of water was added, and the resulting solution was stirred. 153.8 mL of 0.65M Al(LS) solution was added to the resulting solution while stirring, to form a colorless solution. The pH was adjusted to 3.5 with concentrated NaOH while stirring. 25 mL of 4M Zr(LS) was added dropwise while stirring over 2 hours, and a colorless solution was maintained. The volume of the solution was brought up to 2 L with DI water and left to stir overnight. For electroplating, 2 drops of n-octanol and 1 drop of Triton X-100 were added.

Plating Procedure (1) Caswell SP degreaser was made and operated using the procedure suggested by the manufacturer. The steel plates were treated in the electrocleaner for 30 s at a voltage of 6V under cathodic conditions with a stainless steel anode.

(2) The plates were thoroughly rinsed in DI water by immersion and running water.

(3) The plates were activated by submerged in 20% HCl solution for 60 s at room temperature.

(4) The plates were thoroughly rinsed in DI water by immersion and running water.

(5) The plates were plated immediately without drying, using the solution described and the conditions specific to the plate.

(6) The plates were thoroughly rinsed in DI water by immersion and running water.

(7) The plates were dried by warm air convection for testing.

Not every element described herein is required. Indeed, a person of skill in the art will find numerous additional uses for and variations to the methods and compositions described herein, which the inventors intend to be limited only by the claims.

What is claimed is:

1. A composition comprising a first metal complex comprising a first reactive metal and a first electron withdrawing ligand wherein the first electron withdrawing ligand is $OSO_2R^1$, wherein $R^1$ is halo; substituted or unsubstituted $C_6$-$C_{18}$-aryl; substituted or unsubstituted $C_1$-$C_6$-alkyl; and substituted or unsubstituted $C_6$-$C_{18}$-aryl-$C_1$-$C_6$-alkyl, and a second metal complex comprising a second reactive metal and a second electron withdrawing ligand wherein the second withdrawing ligand is $N(SO_3R^1)$, wherein $R^1$ is halo; substituted or unsubstituted $C_6$-$C_{18}$-aryl; substituted or unsubstituted $C_1$-$C_6$-alkyl; and substituted or unsubstituted $C_6$-$C_{18}$-aryl-$C_1$-$C_6$-alkyl, wherein the first reactive metal has a more negative reduction potential than the second reactive metal, wherein the first electron withdrawing ligand decreases the reduction potential of a metal center in the first metal complex below an over-potential for an evolution of hydrogen gas due to a water splitting and the second electron withdrawing ligand decreases the reduction potential of a metal center in the second metal complex below the over-potential for the evolution of hydrogen gas due to the water splitting, wherein the composition further comprises a substantially aqueous medium, wherein the first reactive metal and the second reactive metal can be deposited onto a substrate via electrochemical reduction and wherein the pH of the composition is from about 2 to about 5.

2. The composition of claim 1, wherein the first reactive metal is selected from the group consisting of zirconium, aluminum, titanium, manganese, gallium, vanadium, and niobium.

3. The composition of claim 1, wherein the second reactive metal is selected from the group consisting of aluminum, zirconium, titanium, manganese, gallium, vanadium, and niobium.

4. The composition of claim 1, wherein the first electron withdrawing ligand and second electron withdrawing ligand are independently selected from the group consisting of:

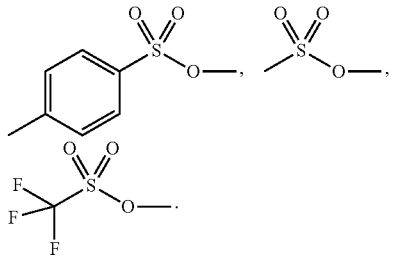

5. The composition of claim 1, further comprising an electrolyte, wherein a concentration of the electrolyte is from about 0.01M to about 1M.

6. The composition of claim 1, further comprising a chelating agent.

7. The composition of claim 6, wherein the chelating agent is selected from the group consisting of sodium bicarbonate, methanesulfonic acid, and organic carboxylate.

8. The composition of claim 7, wherein the pH of the composition is adjusted to between about 2 and about 5.

9. The composition of claim 6, wherein the concentration of the chelating agent is from about 0.01M to about 1M.

10. The composition of claim 1, wherein a ratio of the first metal complex to the second metal complex is from about 0.1:1 to about 1:0.1.

11. The composition of claim 10, wherein the ratio of the first metal complex to the second metal complex is about 1:1.

12. The composition of claim 11, wherein the first metal complex comprises zirconium and the second metal complex comprises aluminum.

13. The composition of claim 1, wherein the concentration of the first metal complex is from about 0.01M to about 0.5M and the concentration of the second metal complex is from about 0.01M to about 0.5M.

14. The composition of claim 13, wherein the concentration of the first metal complex is 0.05M and the concentration of the second metal complex is 0.05M.

15. The composition of claim 14, wherein the first metal complex comprises zirconium and the second metal complex comprises aluminum.

16. The composition of claim 1, further comprising an electrolyte and a chelating agent.

17. The composition of claim 16, wherein the electrolyte and the chelating agent are the same.

* * * * *